US005657029A

United States Patent [19]

Iijima et al.

[11] Patent Number: 5,657,029

[45] Date of Patent: Aug. 12, 1997

[54] GLASS ANTENNA DEVICE FOR AUTOMOBILE TELEPHONE

[75] Inventors: Hiroshi Iijima, Hiroshima; Eiichiro Kawasaki; Ryokichi Doi, both of Ibaraki, all of Japan

[73] Assignee: Nippon Sheet Glass Co., Ltd., Japan

[21] Appl. No.: 548,657

[22] Filed: Oct. 26, 1995

Related U.S. Application Data

[63] Continuation of Ser. No. 193,732, Feb. 9, 1994, abandoned.

[30] Foreign Application Priority Data

Feb. 9, 1993 [JP] Japan ..... 5-021048
Mar. 18, 1993 [JP] Japan ..... 5-058281

[51] Int. Cl.[6] ..... H01Q 1/32

[52] U.S. Cl. ..... 343/713

[58] Field of Search ..... 343/711, 713, 343/700 MS, 829, 830; H01Q 1/32

[56] References Cited

U.S. PATENT DOCUMENTS

| | | | |
|---|---|---|---|
| 4,746,925 | 5/1988 | Toriyama | 343/713 |
| 4,893,126 | 1/1990 | Evans | 343/700 MS X |
| 5,138,330 | 8/1992 | Lindenmeier et al. | 343/713 |
| 5,220,336 | 6/1993 | Hirotsu et al. | 343/713 |
| 5,248,947 | 9/1993 | Shiga | 343/700 MS X |
| 5,255,002 | 10/1993 | Day | 343/713 |
| 5,521,606 | 5/1996 | Iijima et al. | 343/713 |

FOREIGN PATENT DOCUMENTS

| | | | |
|---|---|---|---|
| 9111830 | 8/1991 | Germany | H01Q 1/32 |
| 0031204 | 2/1987 | Japan | H01Q 1/32 |
| 3-265202 | 11/1991 | Japan | H01Q 1/32 |
| 4314202 | 11/1992 | Japan | H01Q 1/32 |

*Primary Examiner*—Donald T. Hajec
*Assistant Examiner*—Tho Phan
*Attorney, Agent, or Firm*—Merchant, Gould, Smith, Edell, Welter & Schmidt

[57] ABSTRACT

A glass antenna device for automobile telephone includes a glass panel and an antenna pattern mounted on the glass panel. The antenna pattern has a radiation pattern, a signal leader pattern having a first feeder positioned closely to an edge of the glass panel, and an extension extending from the first feeder toward and connected to the radiation pattern, a shield leader pattern having a surrounding pattern surrounding the first feeder and having a second feeder, and a pair of parallel extensions extending from the surrounding pattern parallel substantially the full length of the extension of the signal leader thereto and disposed one on each side thereof, and a rectangular ground pattern connected to an end of at least one of the parallel extensions of the shield leader pattern. Preferably, a feeder cable interconnecting the antenna pattern and an automobile telephone set mounted in an automobile has a portion extending toward the antenna pattern and including a ground conductor electrically connected to an automobile body of the automobile.

13 Claims, 22 Drawing Sheets

FIG. 4

| | NTT POLE (a) | GLASS (b) |
|---|---|---|
| FREQUENCY (MHz) | GRAY | SIDE FEEDING |
| 790 | −4.2 | −6.3 |
| 800 | −4.2 | −6.0 |
| 810 | −3.9 | −6.1 |
| 820 | −4.4 | −5.9 |
| 830 | −4.4 | −5.2 |
| 840 | −3.9 | −4.8 |
| 850 | −3.8 | −4.6 |
| 860 | −3.6 | −4.3 |
| 870 | −3.7 | −4.7 |
| 880 | −4.1 | −5.2 |
| 890 | −4.5 | −5.5 |
| 900 | −4.4 | −5.5 |
| 910 | −4.5 | −5.6 |
| 920 | −4.0 | −5.1 |
| 930 | −4.1 | −5.3 |
| 940 | −4.5 | −5.6 |
| 950 | −4.6 | −5.8 |
| 960 | −4.6 | −6.2 |
| 970 | −4.8 | −7.0 |
| AVERAGE | −4.2 | −5.5 |

REFERENCE OdB : DIPOLE

FIG. 7

REFERENCE 0dB : DIPOLE
UNIT [dB]

| | | SIDE FEEDING | |
|---|---|---|---|
| FREQUENCY (MHz) | NO LEADER LINE | WITHOUT JUMPER | WITH JUMPER |
| 790 | −5.8 | −7.1 | −5.5 |
| 800 | −6.2 | −7.6 | −6.0 |
| 810 | −6.3 | −7.3 | −5.9 |
| 820 | −6.7 | −7.3 | −6.2 |
| 830 | −6.6 | −7.1 | −6.2 |
| 840 | −6.6 | −7.0 | −6.2 |
| 850 | −6.5 | −6.8 | −6.2 |
| 860 | −6.4 | −6.8 | −6.2 |
| 870 | −5.9 | −7.0 | −6.2 |
| 880 | −5.6 | −7.5 | −6.5 |
| 890 | −5.6 | −8.1 | −7.3 |
| 900 | −5.8 | −7.8 | −7.2 |
| 910 | −5.7 | −7.8 | −7.0 |
| 920 | −5.7 | −7.8 | −7.2 |
| 930 | −5.7 | −7.1 | −6.8 |
| 940 | −5.8 | −7.1 | −6.8 |
| 950 | −5.7 | −7.4 | −6.9 |
| 960 | −6.2 | −7.7 | −6.8 |
| 970 | −6.2 | −8.1 | −7.0 |
| AVERAGE | −6.1 | −7.4 | −6.5 |

FIG.18

REFERENCE 0dB : DIPOLE
UNIT [dB]

| | SIDE FEEDING (WITH JUMPER) | | | |
|---|---|---|---|---|
| FREQUENCY (MHz) | SINGLE ELEMENT | V-SHAPED | T-SHAPED | INVERTED L-SHAPED |
| 790 | -5.5 | -5.6 | -5.7 | -5.6 |
| 800 | -6.0 | -6.1 | -6.2 | -6.1 |
| 810 | -5.9 | -6.0 | -6.1 | -6.0 |
| 820 | -6.2 | -6.3 | -6.4 | -6.2 |
| 830 | -6.2 | -6.2 | -6.3 | -6.2 |
| 840 | -6.2 | -6.2 | -6.3 | -6.2 |
| 850 | -6.2 | -6.2 | -6.3 | -6.3 |
| 860 | -6.2 | -6.2 | -6.3 | -6.3 |
| 870 | -6.2 | -6.2 | -6.4 | -6.3 |
| 880 | -6.5 | -6.4 | -6.7 | -6.6 |
| 890 | -7.3 | -7.0 | -7.4 | -7.3 |
| 900 | -7.2 | -6.9 | -7.3 | -7.2 |
| 910 | -7.0 | -7.1 | -7.1 | -7.0 |
| 920 | -7.2 | -7.3 | -7.3 | -7.2 |
| 930 | -6.8 | -6.9 | -6.8 | -6.8 |
| 940 | -6.8 | -6.9 | -6.8 | -6.9 |
| 950 | -6.9 | -7.1 | -6.9 | -7.0 |
| 960 | -6.8 | -7.0 | -6.8 | -6.9 |
| 970 | -7.0 | -7.2 | -7.0 | -7.1 |
| AVERAGE | -6.5 | -6.5 | -6.5 | -6.5 |

GLASS ANTENNA DEVICE FOR AUTOMOBILE TELEPHONE

This is a continuation of application Ser. No. 08/193,732, filed Feb. 9, 1994, now abandoned.

BACKGROUND OF THE INVENTION

1. Field of the Invention

The present invention relates to a glass antenna device for use with an automobile telephone set, and more particularly to a glass antenna device for use as a UHF-band transmission and reception antenna on an automobile window glass panel.

2. Description of the Prior Art

Japanese utility model application No. 4-38628 discloses a glass antenna device for use with an automobile telephone set. As shown in FIG. 24 of the accompanying drawings, the disclosed glass antenna device comprises a radiation pattern P1 having a vertical length of about ¼ of the wavelength of signals to be radiated, and a ground pattern P2 having a vertical length of about ¼ of the wavelength of signals to be radiated and a horizontal length ranging from about ¼ to ¾ of the wavelength of signals to be radiated. The radiation and ground patterns P1, P2 are adapted to be mounted on a window glass panel of an automobile. The ground pattern P2 has a centrally open shape comprising an outer frame pattern P2*a* and a central vertical pattern P2*b*.

The horizontal length of the ground pattern P2 is relatively large, and the radiation pattern P1, particularly its feeder, is located in alignment with the center of the ground pattern P2 in the horizontal direction. Therefore, the glass antenna device cannot be positioned closely to an edge of the window glass panel, i.e., the feeder of the radiation pattern P1 cannot be positioned on a black ceramic strip on the edge of the window glass panel.

Furthermore, since the ground pattern P2 is not connected to an automobile body as ground, telephone communications made through the automobile telephone set are susceptible to various noises produced by other electronic devices, including an FM receiver, TV receiver, etc., which may be mounted on the automobile.

The introduction of noises may be reduced by connecting the ground pattern P2 to the automobile body. However, as the ground pattern P2 has no connection terminals, it is difficult to join a ground line to the ground pattern P2. Even if it is possible to connect the ground pattern P2 to the automobile body, the antenna characteristics of the glass antenna device are altered by the grounding, making it impossible for the glass antenna device to achieve its desired performance.

A known double-loop glass antenna device for automobile telephone is disclosed in Japanese laid-open patent publication No. 4-14304.

As shown in FIG. 25 of the accompanying drawings, the disclosed double-loop glass antenna device, generally designated by the reference numeral 101, has two half-loop conductors 103*a*, 103*b*, two reactive conductors 104*a*, 104*b* connected to the respective half-loop conductors 103*a*, 103*b*, and a ground conductor 105 connected to the reactive conductors 104*a*, 104*b*, the conductors 103*a*, 103*b*, 104*a*, 104*b*, 105 being mounted on a rear or front window glass panel 102. The reactive conductors 104*a*, 104*b* are of an L-shaped pattern connected between the half-loop conductors 103*a*, 103*b* and the ground conductor 105.

The half-loop conductors 103*a*, 103*b* are joined to each other at a feeding point 106 that is connected to a core 107*a* of a feeder cable 107. The feeder cable 107 includes an outer conductor 107*b* connected to the ground conductor 105 for feeding the glass antenna device 101 in an unbalanced fashion.

The half-loop conductors 103*a*, 103*b* and the ground conductor 105 are horizontally relatively long, and the feeding point 106 is positioned in alignment with the center of the half-loop conductors 103*a*, 103*b* and the ground conductor 105 in the horizontal direction. Therefore, the glass antenna device 101 cannot be positioned closely to an edge of the window glass panel 102, i.e., the feeding point 106 cannot be positioned on a black ceramic strip on the edge of the window glass panel 102. Inasmuch as the ground conductor 105 is not connected to an automobile body as ground, telephone communications made through an automobile telephone set connected to the glass antenna device 101 are susceptible to various noises produced by other electronic devices, including an FM receiver, TV receiver, etc., which may be mounted on the automobile.

SUMMARY OF THE INVENTION

It is therefore an object of the present invention to provide a glass antenna device for automobile telephone which has a feeding point that is positioned on a side edge portion of an antenna pattern to make it easy to locate the feeding point closely to an edge of a window glass panel.

Another object of the present invention is to provide a glass antenna device for automobile telephone which includes a ground pattern that is connected to an automobile body without greatly affecting antenna characteristics for thereby reducing noises introduced from other electronic devices.

According to the present invention, there is provided a glass antenna device for automobile telephone, comprising a glass panel, and an antenna pattern mounted on the glass panel, the antenna pattern comprising a radiation pattern, a signal leader pattern having a first feeder positioned closely to an edge of the glass panel, and an extension extending from the first feeder toward and connected to the radiation pattern, a shield leader pattern having a surrounding pattern surrounding the first feeder and having a second feeder, and a pair of parallel extensions extending from the surrounding pattern substantially the full length of the extension of the signal leader pattern parallel thereto and disposed one on each side thereof, and a rectangular ground pattern connected to an end of at least one of the parallel extensions of the shield leader pattern.

The shield leader pattern may have a balanced-to-unbalanced converter such as a Sperrtopf element.

The parallel extensions may have respective ends connected to each other through a junction which is held out of contact with junction through which the signal leader pattern is connected to the radiation pattern.

The ground pattern may comprise a centrally open rectangular pattern.

The edge of the glass panel may be straight, and the first feeder my be positioned closely to the straight edge of the glass panel, and the extension of the signal leader pattern may extend linearly parallel to the straight edge of the glass panel. Alternatively, the edge of the glass panel may be curved, and the first feeder may be positioned closely to the curved edge of the glass panel, and the extension of the signal leader pattern may be curved parallel to the curved edge of the glass panel.

The glass antenna device may further include a feeder cable interconnecting the antenna pattern and an automobile telephone set mounted in an automobile, the feeder cable having a portion extending toward the antenna pattern and including a ground conductor electrically connected to an automobile body of the automobile.

The above and further objects, details and advantages of the present invention will become apparent from the following detailed description of preferred embodiments thereof, when read in conjunction with the accompanying drawings.

BRIEF DESCRIPTION OF THE DRAWINGS

FIG. 4 is a table of numerical values of the antenna gains shown in FIG. 3;

FIG. 7 is a table of numerical values of the antenna gains shown in FIG. 6;

FIG. 18 is a table of numerical values of the antenna gains shown in FIG. 17;

DETAILED DESCRIPTION OF THE PREFERRED EMBODIMENTS

Figure 1:
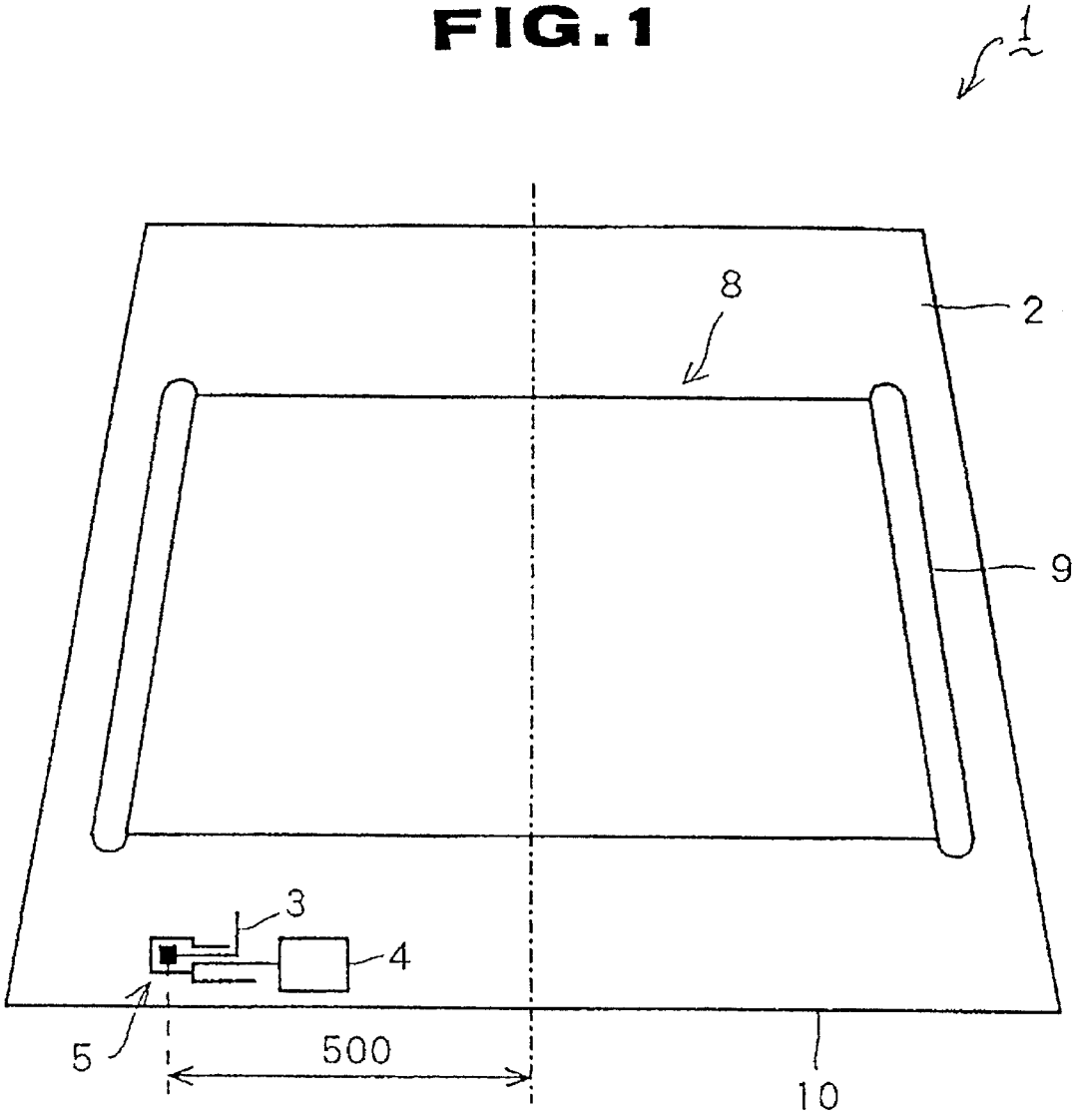
FIG. 1 is a schematic plan view of a glass antenna device for automobile telephone according to a first embodiment of the present invention, the glass antenna device being viewed from within the passenger compartment of an automobile.

As shown in FIG. 1, a glass antenna device 1 for automobile telephone according to a first embodiment of the present invention comprise a window glass panel 2 and an antenna pattern mounted on the window glass panel. The antenna pattern includes a radiation pattern 3, a ground pattern 4, and a leader line 5. The window glass panel 2 supports thereon a heater wire 8 for defrosting the window glass panel 2 and a bus bar 9 for supplying an electric current to the heater wire 8.

Figure 2:
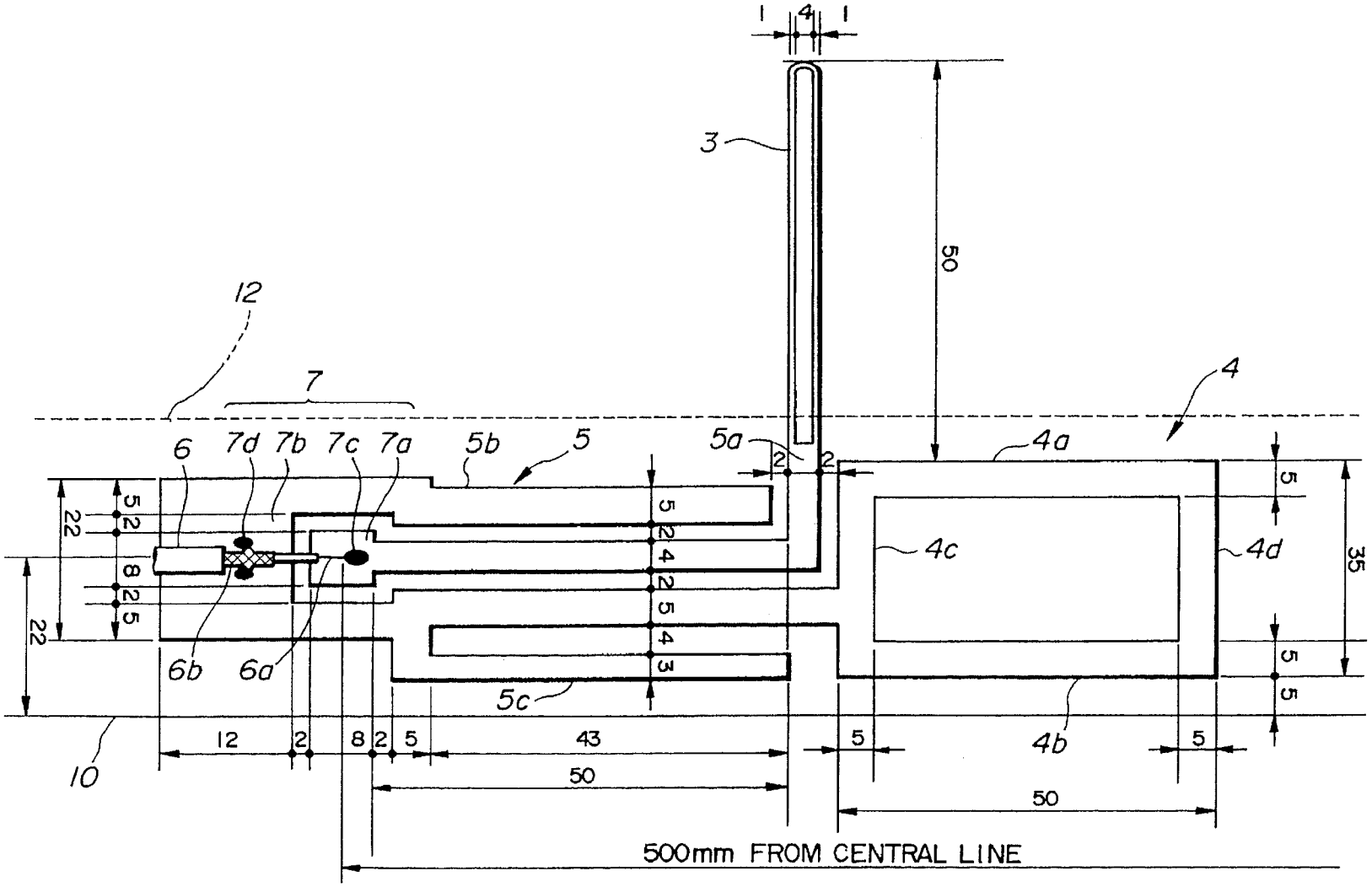
FIG. 2 is an enlarged plan view of an antenna pattern of the glass antenna device according to the first embodiment, the view also showing preferred dimensions of the glass antenna device.

As shown in detail in FIG. 2, a feeder 7 comprises a feeder electrode 7*a* and a ground electrode 7*b* which are fixed respectively to the radiation and ground patterns 3, 4. A coaxial feeder cable 6 comprises an internal conductor or core 6*a* and an external conductor or braided copper wire 6*b*. The core 6*a* and the braided copper wire 6*b* are connected at one end of the coaxial feeder cable 6 to the feeder and ground electrodes 7*a*, 7*b*, respectively. The coaxial feeder cable 6 is connected at the opposite end thereof to a telephone set (not shown) mounted in an automobile. The feeder 7 is positioned within about 50 mm from a straight edge 10 of the window glass panel 2. The feeder electrode 7*a* has a feeding point 7*c*, and the ground electrode 7*b* has a feeding point or ground point 7*d*.

In FIG. 1, the radiation and ground patterns 3, 4 are positioned below the heater wire 8. However, they may be positioned above the heater wire 8.

In the embodiment shown in FIGS. 1 and 2, only the single glass antenna device 1 is positioned below the left-hand end of the heater wire 8. However, it is preferable that two glass antenna devices 1 be positioned in two out of four locations above and below the left- and right-hand ends of the heater wire 8 for diversity reception.

Each of the radiation and ground patterns 3, 4 may be formed by printing an electrically conductive paste of fine particles of silver, glass of low melting point, etc. dissolved in an organic solvent on the window glass panel 2 by screen printing, and baking the printed paste into an electrically conductive strip, an electrically conductive thin metal wire, an electrically conductive metal foil, or the like.

The ground pattern 4 is of a centrally open rectangular shape composed of outer frame patterns 4*a*, 4*b*, 4*c*, 4*d* each having a length substantially equal to ¼ of the wavelength λ of signals to be received by the glass antenna device 1. The outer frame patterns 4*a*, 4*b* extend linearly parallel to the edge 10 of the window glass panel 2, and the outer frame patterns 4*c*, 4*d* and the radiation pattern 3 extend linearly perpendicularly to the edge 10 of the window glass panel 2.

The outer frame patterns 4*a*, 4*b*, 4*c*, 4*d* of the ground pattern 4 have the length ¾ at a frequency of 900 MHz at the time the antenna pattern has a shrinkage factor of 0.6.

In FIG. 2, the window glass panel 2 has a black ceramic strip printed thereon which has an edge 12.

The ground pattern 4 has a length or horizontal dimension of 50 mm and a width or vertical dimension of 35 mm, and each of the outer frame patterns 4*a*, 4*b*, 4*c*, 4*d* has a width of 5 mm. The radiation pattern 3 is also of a centrally open shape having a width or horizontal dimension of 4 mm and a length or vertical dimension of 50 mm (about ¾). The radiation pattern 3 has a marginal edge having a width of 1 mm. The above dimensions and other dimensions given below are of approximate values, and the glass antenna device according to the present invention is not limited to these specific dimensions.

The leader line 5 comprises a signal leader pattern 5*a* and a shield leader pattern 5*b*, and extends substantially parallel to the glass edge 10.

The signal leader pattern 5*a* extends vertically downwardly over a distance of 18 mm continuously from the lower end of the radiation pattern 3 that lies perpendicularly to the glass edge 10, and then extends horizontally to the left over a distance of 50 mm parallel to the glass edge 10 into connection with the feeder electrode 7*a*. Therefore, the signal leader pattern 5*a* is composed of the feeder electrode 7*a* and an extension extending therefrom toward the radiation pattern 3.

The feeder electrode 7*a* is spaced a distance of 58 mm from the outer frame pattern 4*c*, and is substantially of a square shape having a width of 8 mm and a length of 8 mm. The center of the feeder electrode 7*a* is spaced from the vertical central line of the window glass panel 2 by a distance of 500 mm.

The signal leader pattern 5*a* and the outer frame pattern 4*c* are spaced from each other by a distance of 2 mm.

The shield leader pattern 5*b* extends horizontally to the left from an intermediate portion of the outer frame pattern 4*c* parallel to the glass edge 10 beyond the feeder electrode 7*a*, is then bent vertically upwardly perpendicularly to the glass edge 10, and then extends horizontally to the right parallel to the glass edge 10 along the signal leader pattern 5*a* in surrounding relation to the feeder electrode 7*a* to a position near the radiation pattern 3 where it terminates in an open end. The shield leader pattern 5*b* has a width of 5 mm at its horizontally elongate portions, and is spaced a distance of 2 mm from the signal leader pattern 5*b*, and a distance of 2 mm from the feeder electrode 7*a* on its upper, lower, and lateral sides.

Therefore, the shield leader pattern 5*b* is composed of the ground electrode 7*b*, a surrounding portion extending therefrom around the feeder electrode 7*a* of the signal leader pattern 5*a*, and a pair of parallel extensions extending substantially the full length of the extension of the signal leader pattern 5*a* substantially parallel to the extension of the signal leader pattern 5*a*, one on each side thereof. The shield leader pattern 5*b* has its open distal end spaced a distance of 2 mm from the signal leader pattern 5*a* where it is joined to the radiation pattern 3.

The open distal end of the shield leader pattern 5*b* which extends closely to the radiation pattern 3, i.e., the distal end Of the upper extension of the shield leader pattern 5*b*, may be three-dimensionally connected to the outer frame pattern 4*c* of the ground pattern 4 by a connector (not shown) bridging over the signal leader pattern 5*a*, or the extension of the signal leader pattern 5*a*, or the junction between the extension of the signal leader pattern 5*a* and the radiation pattern 3, to lower the impedance of the leader line 5 to reduce any loss caused by the leader line 5. Such an arrangement results in a more preferable antenna pattern.

The leader line 5 also includes a branch pattern 5*c* branched off an intermediate portion of the shield leader pattern 5*b*, i.e., an intermediate portion of the lower extension of the shield leader pattern 5*b*, serves as a balanced-to-unbalanced converter having a length of about ¾, referred to as Sperrtopf element, for increasing the impedance of the junction on the feeding point to prevent a current from flowing into the leader line (ground). The branch pattern or Sperrtopf element 5*c* has a width of 3 mm and a length of 43 mm, and is spaced a distance of 4 mm from the shield leader pattern 5*b*. The Sperrtopf element 5*c* may be dispensed with under certain conditions.

If the window glass panel 2 comprises a laminated glass panel, then the above antenna pattern is mounted on a mating surface thereof, or an internal or external surface thereof. If the window glass panel 2 comprises a single glass panel, then the above antenna pattern is mounted on an internal or external surface thereof.

Figure 3:
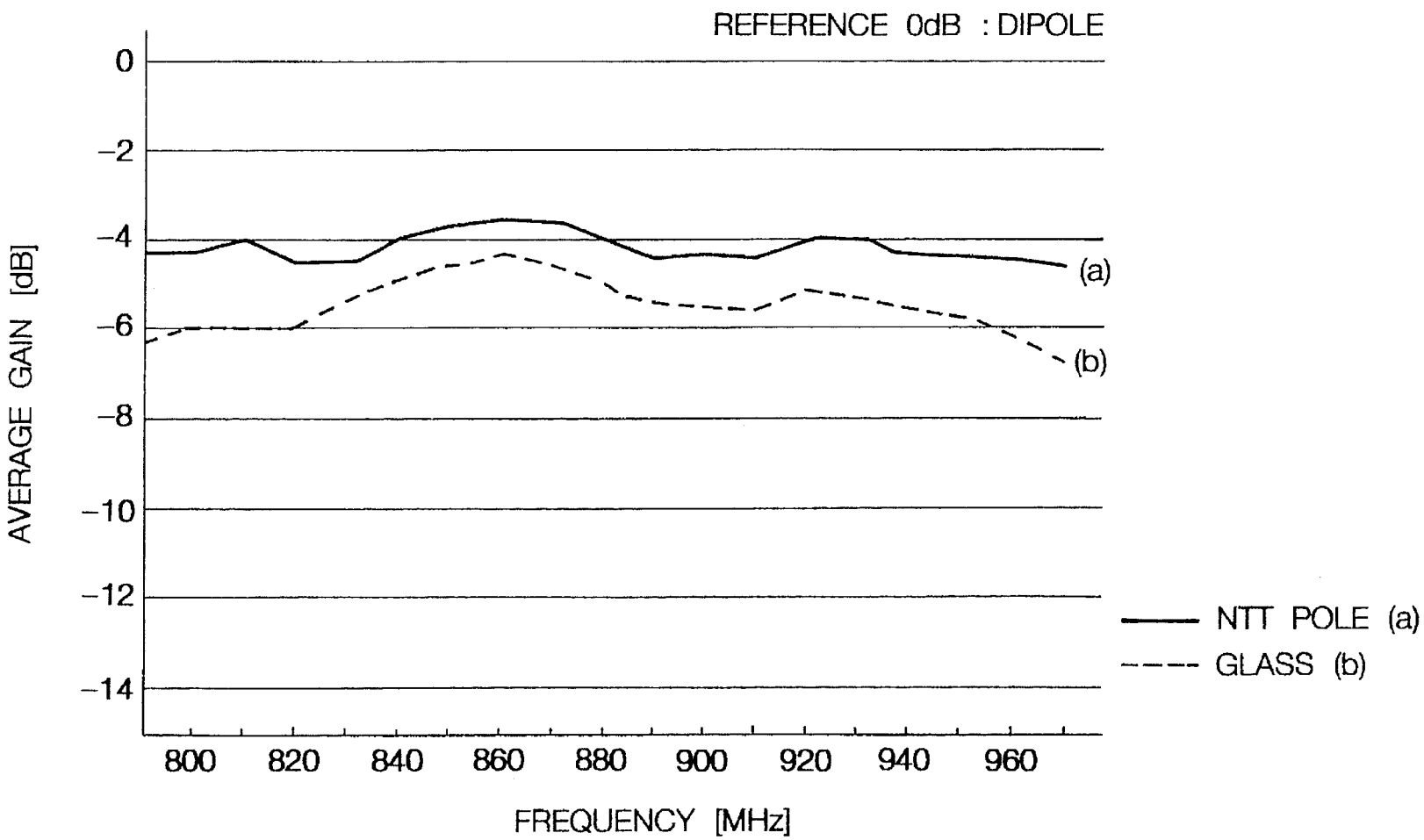
FIG. 3 is a graph showing the frequency-dependent antenna gains of the glass antenna device according to the first embodiment shown in FIG. 2.
Figure 24:
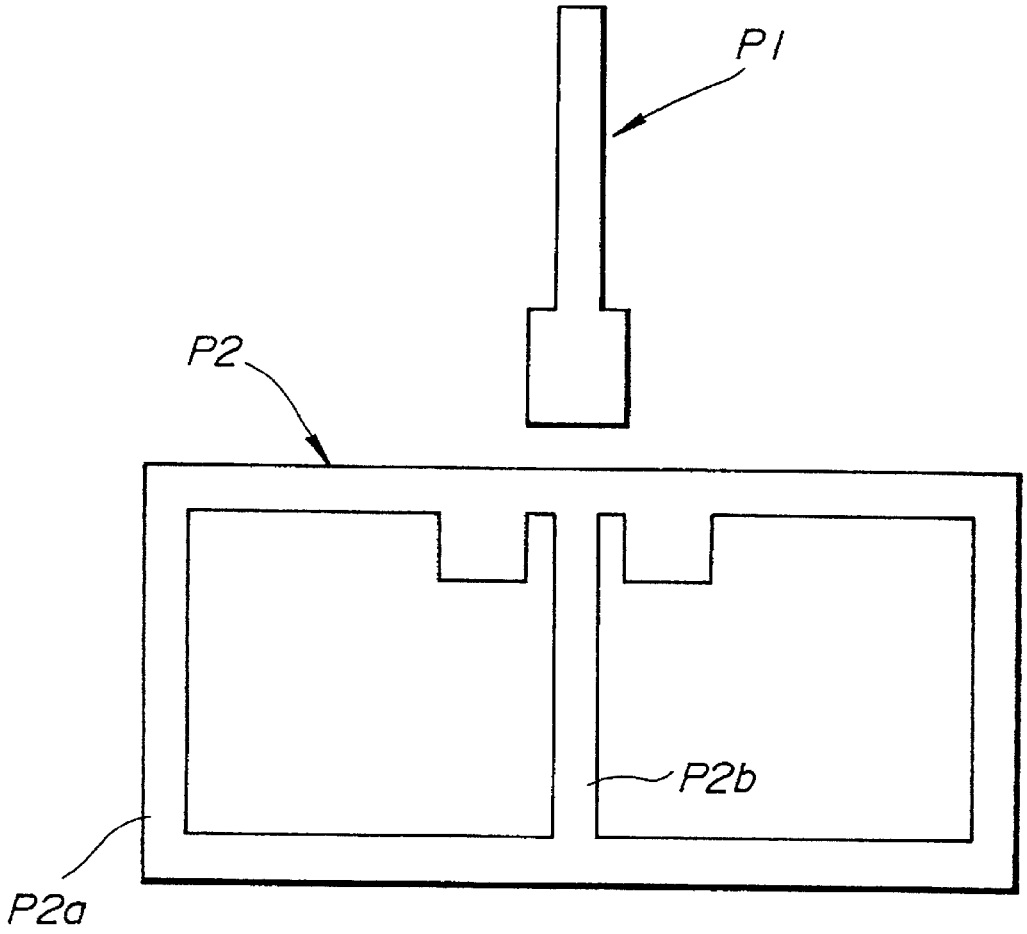
FIG. 24 (PRIOR ART)
FIG. 24 is a schematic plan view of a conventional glass antenna device for automobile telephone.

FIG. 3 shows the frequency-dependent antenna gains of the glass antenna device 1 according to the first embodiment shown in FIG. 2, as measured when the glass antenna device 1 was installed on an automobile. The graph of FIG. 3 has a horizontal axis representing frequencies (MHz) and a vertical axis representing average antenna gains (dB). The numerical values of the antenna gains are shown in the table of FIG. 4. The numerical values under NTT pole (a) in FIG. 4 indicate the gains of an NTT (Nippon Telephone and Telegraph) pole antenna, and the numerical values under side feeding (b) indicate the gains of the antenna pattern according to the first embodiment with side feeding (the conventional antenna pattern shown in FIG. 24 operates where central feeding as the feeding point thereof is centrally located, whereas the antenna pattern according to the first embodiment operates where side feeding as the feeding point is located on a side of the antenna pattern as shown in FIG. 2). The term "GRAY" in FIG. 4 represents a transmission/reception antenna among diversity antennas (for measurements, a coaxial feeder line, 70 cm long, under the type No. 2.5D-2V was connected).

Study of FIG. 4 indicates that if a reference gain of 0 dB is obtained by a standard dipole antenna, then the gain of the glass antenna device according to the first embodiment is only 1.3 dB lower than the better gain of the NTT pole antenna in the full measured range of frequencies from 790 to 970 MHz.

Figure 5:
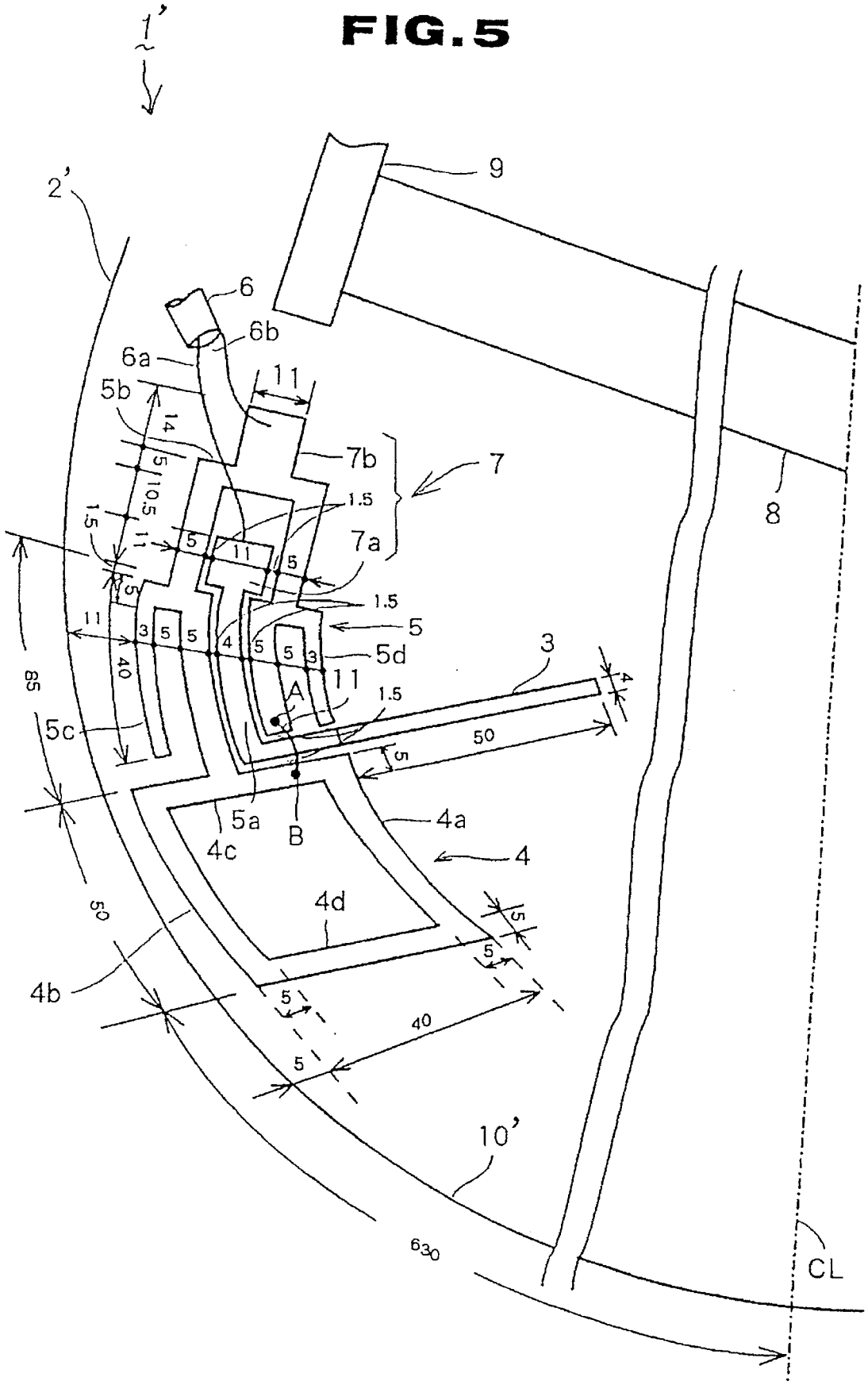
FIG. 5 is a plan view of an antenna pattern of a glass antenna device according to a second embodiment of the present invention, the view also showing preferred dimensions of the glass antenna device.

FIG. 5 illustrates an antenna pattern of a glass antenna device 1' according to a second embodiment of the present invention. Those parts shown in FIG. 5 which are functionally identical to those shown in FIG. 2 are denoted by identical reference characters. The glass antenna device 1' includes a window glass panel 2' having a curved or round side edge 10', and has an antenna pattern that is designed for use on such a window glass panel 2'.

In FIG. 5, a coaxial feeder cable 6 is shown as being largely spaced from radiation and ground patterns 3, 4 for illustrative purpose only. Actually, the coaxial feeder cable 6 has a core 6a and a braided copper wire 6b that are connected at one end of the coaxial feeder cable 6 to feeder and ground electrodes 7a, 7b, respectively of a feeder 7 over respective minimum distances. The coaxial feeder cable 6 is connected at the opposite end thereof to a telephone set (not shown) mounted in an automobile.

In the second embodiment shown in FIG. 5, the ground pattern 4 is of a centrally open rectangular shape composed of outer frame patterns 4a, 4b, 4c, 4d each having a length substantially equal to ¼ of the wavelength λ of signals to be received by the glass antenna device 1'. The outer frame patterns 4a, 4b are curved parallel to an edge 10' of the window glass panel 2', and the outer frame patterns 4c, 4d and the radiation pattern 3 extend linearly perpendicularly to the edge 10' of the window glass panel 2'. The ground pattern 4 is positioned such that the outer frame pattern 4d is spaced a distance of 630 mm from the central line CL of the window glass panel 2'. The ground pattern 4 has a horizontal dimension of 40 mm and a vertical dimension of 50 mm, and each of the outer frame patterns 4a, 4b, 4c, 4d has a width of 5 mm. The radiation pattern 3 has a width of 4 mm and a length of 50 mm.

A leader line 5 comprises a signal leader pattern 5a and a shield leader pattern 5b.

The signal leader pattern 5a extends downwardly over a distance of 13 mm continuously from the lower end of the radiation pattern 3 that lies perpendicularly to the glass edge 10', and then extends over a distance of 41.5 mm parallel to the glass edge 10' into connection with the feeder electrode 7a.

The feeder electrode 7a is spaced a distance of 85 mm from the outer frame pattern 4c, and is substantially of a square shape having a width of 11 mm and a length of 11 mm. The feeder 7 is positioned within 50 mm from the glass edge 10'.

The signal leader pattern 5a and the outer frame pattern 4c are spaced from each other by a distance of 1.5 mm.

The shield leader pattern 5b extends from an intermediate portion of the outer frame pattern 4c parallel to the glass edge 10' along the signal leader pattern 5a beyond the feeder electrode 7a, is then bent perpendicularly to the glass edge 10', and then extends in a curved pattern parallel to the glass edge 10' along the signal leader pattern 5a in surrounding relation to the feeder electrode 7a to a position near the radiation pattern 3 where it terminates in an open end.

The shield leader pattern 5b has a width of 5 mm at its elongate portions, and is spaced a distance of 1.5 mm from the signal leader pattern 5a, and a distance of 10.5 mm from the feeder electrode 7a on its upper side and a distance of 1.5 mm from the feeder electrode 7a on its other sides.

The open distal end of the shield leader pattern 5b is spaced a distance of 1.5 mm from the signal leader pattern 5a where it is connected to the radiation pattern 3.

The shield leader pattern 5b includes a ground electrode 7b extending upwardly from an intermediate portion of its section that extends perpendicularly to the glass edge 10'. The ground electrode 7b and the feeder electrode 7a jointly serve as the feeder 7.

The ground electrode 7b has a width of 11 mm and a length of 14 mm.

The feeder and ground electrodes 7a, 7b are wider than the leader patterns because coaxial feeder connectors are connected to the feeder and ground electrodes 7a, 7b for connection to the coaxial feeder cable 6.

In the second embodiment, the open distal end of the shield leader pattern 5b that extends closely to the radiation pattern 3 and the outer frame pattern 4c, i,e., a point A on the open distal end of the shield leader pattern 5b and a point B on the outer frame pattern 4c, are three-dimensionally connected to each other by a jumper wire 11 that extends parallel to the glass edge 10' over the signal leader pattern 5a or the junction between the signal leader pattern 5a and the radiation pattern 3. The jumper wire 11, which may comprise a metal wire covered with a vinyl tube, is soldered to the shield leader pattern 5b and the outer frame pattern 4c.

The jumper wire 11 may alternatively be a flat metal strip or any of various other conductors insofar as it can extend between the open distal end of the shield leader pattern 5b and the outer frame pattern 4c without allowing the open distal end of the shield leader pattern 5b to be connected to the signal leader pattern 5a.

The shield leader pattern 5b also includes branch patterns 5c, 5d serving as Sperrtopf elements which are branched off intermediate portions of its elongate sections.

The Sperrtopf element 5c has a width of 3 mm and a length of 40 mm, and is spaced a distance of 5 mm from the shield leader pattern 5b. The Sperrtopf element 5d has a width of 3 mm and a length of 40 mm, and is spaced a distance of 5 mm from the shield leader pattern 5b.

Figure 6:
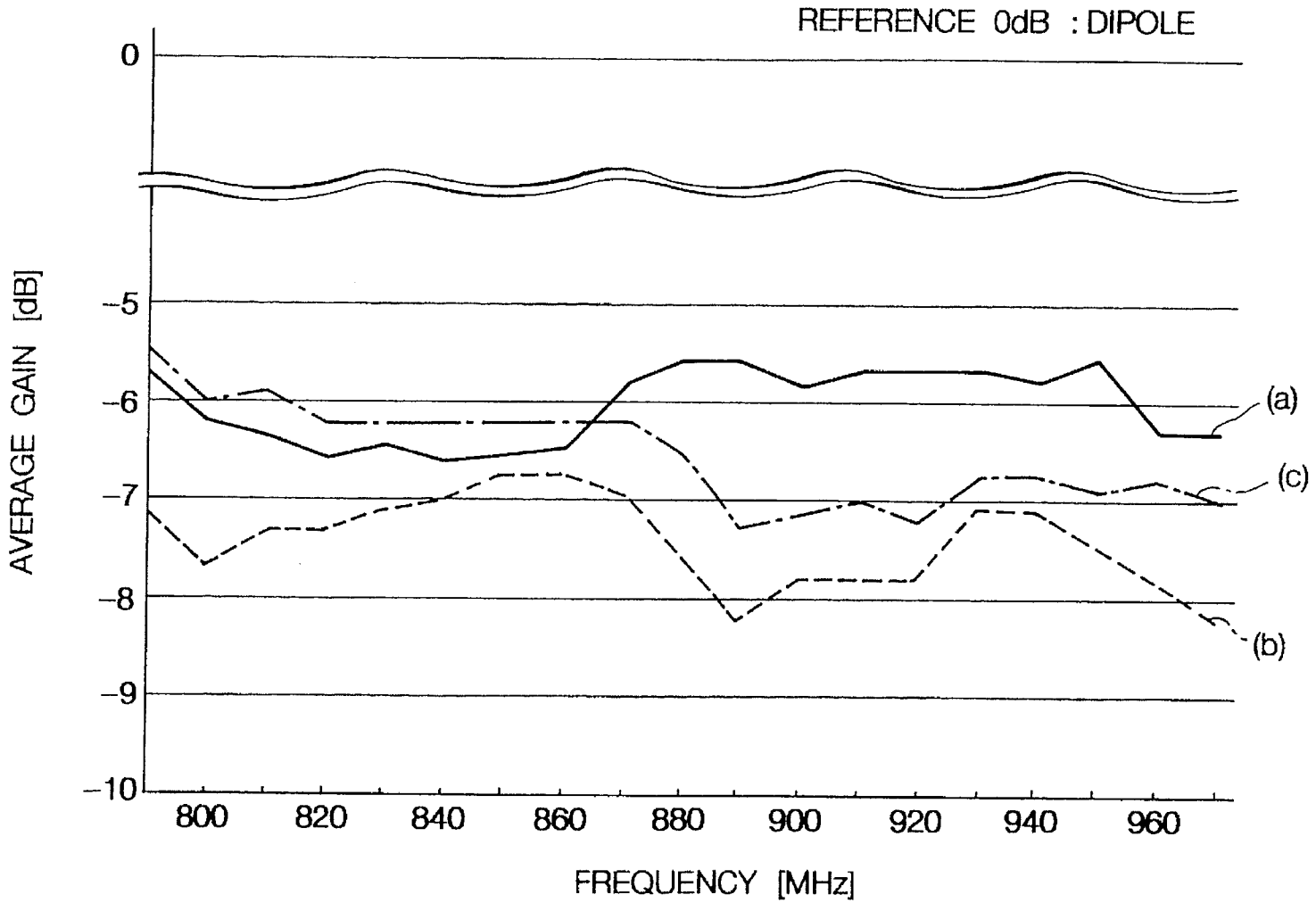
FIG. 6 is a graph showing the frequency-dependent antenna gains of the glass antenna device according to the second embodiment shown in FIG. 5.
Figure 8:
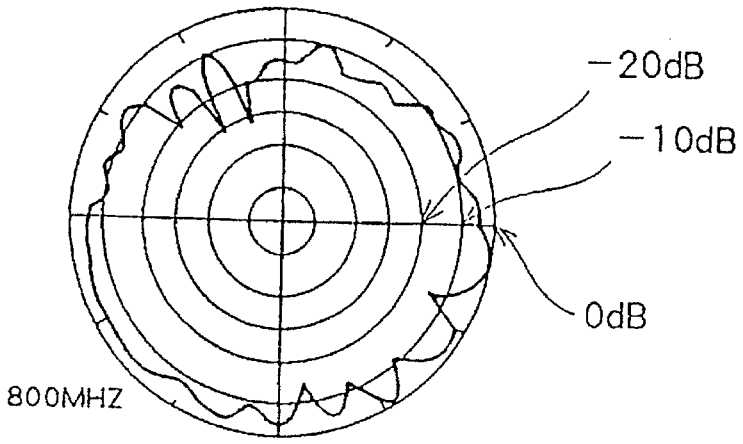
FIG. 8 is a diagram of a directivity pattern of the glass antenna device according to the second embodiment, as measured with respect to a V-polarized wave having a frequency of 800 MHz when the glass antenna device was mounted on an automobile.
Figure 9:
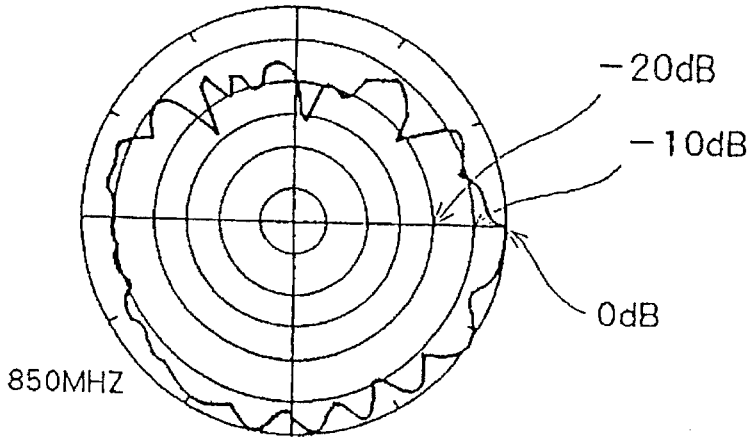
FIG. 9 is a diagram of a directivity pattern of the glass antenna device according to the second embodiment, as measured with respect to a V-polarized wave having a frequency of 850 MHz when the glass antenna device was mounted on an automobile.
Figure 10:
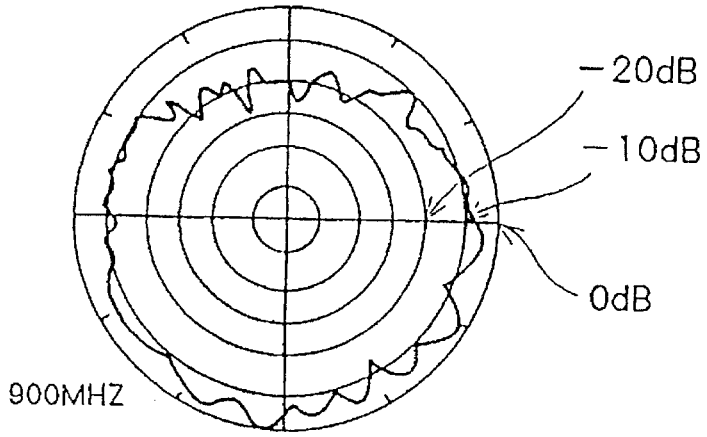
FIG. 10 is a diagram of a directivity pattern of the glass antenna device according to the second embodiment, as measured with respect to a V-polarized wave having a frequency of 900 MHz when the glass antenna device was mounted on an automobile.
Figure 11:
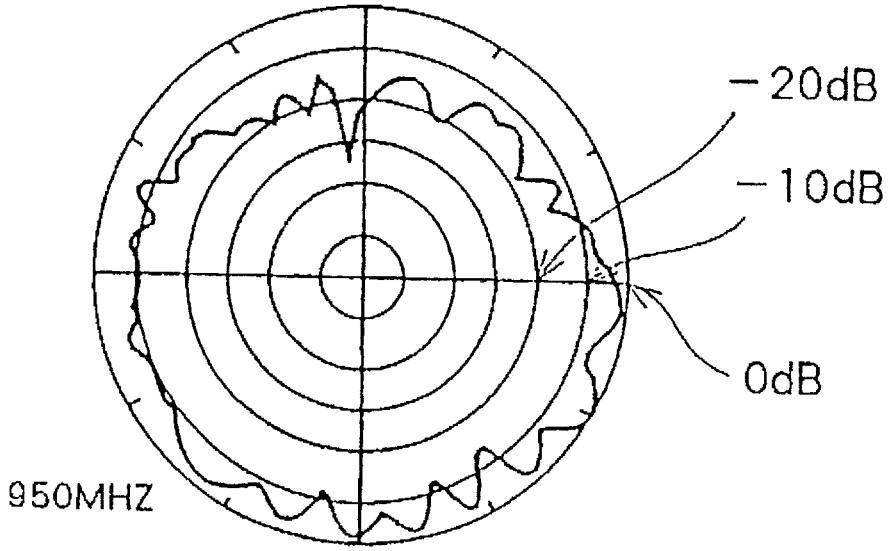
FIG. 11 is a diagram of a directivity pattern of the glass antenna device according to the second embodiment, as measured with respect to a V-polarized wave having a frequency of 950 MHz when the glass antenna device was mounted on an automobile.

FIG. 6 shows the frequency-dependent antenna gains of the glass antenna device 1' according to the first embodiment shown in FIG. 5, as measured when the glass antenna device 1' was installed on an automobile. The graph of FIG. 6 has a horizontal axis representing frequencies (MHz) and a vertical axis representing average antenna gains (dB). The numerical values of the antenna gains are shown in the table of FIG. 7. The curve (a) in FIG. 6 indicates the average gains of a conventional antenna having a radiation pattern for a 900 MHz band and a ground pattern, i.e., an antenna equivalent to the antenna pattern according to the second embodiment with the leader line omitted. The curve (b) in FIG. 6 indicates the average gain of the antenna pattern according to the second embodiment with side feeding and without any jumper wire, and the curve (c) in FIG. 6 indicates the average gains of the antenna pattern according to the second embodiment with side feeding and with a jumper wire.

It can be seen from FIG. 6 that if a reference gain of 0 dB is obtained by a standard dipole antenna, then the gain of the glass antenna device according to the second embodiment with side feeding and without any jumper wire is 1.3 dB lower than the gain of the standard dipole antenna in the full measured range of frequencies from 790 to 970 MHz, and the gain of the glass antenna device according to the second embodiment with side feeding and with a jumper wire is only 0.4 dB lower than the gain of the standard dipole antenna in the full measured range of frequencies from 790 to 970 MHz.

FIGS. 8 through 11 show respective directivity patterns of the glass antenna device 1' according to the second embodiment, as measured with respect to V-polarized waves having respective frequencies of 800, 850, 900, 950 MHz when the glass antenna device was mounted on an automobile.

It will be understood from FIGS. 8 through 11 that the glass antenna device 1' according to the second embodiment exhibits sufficient practical performances though it operates with side feeding.

Figure 12:
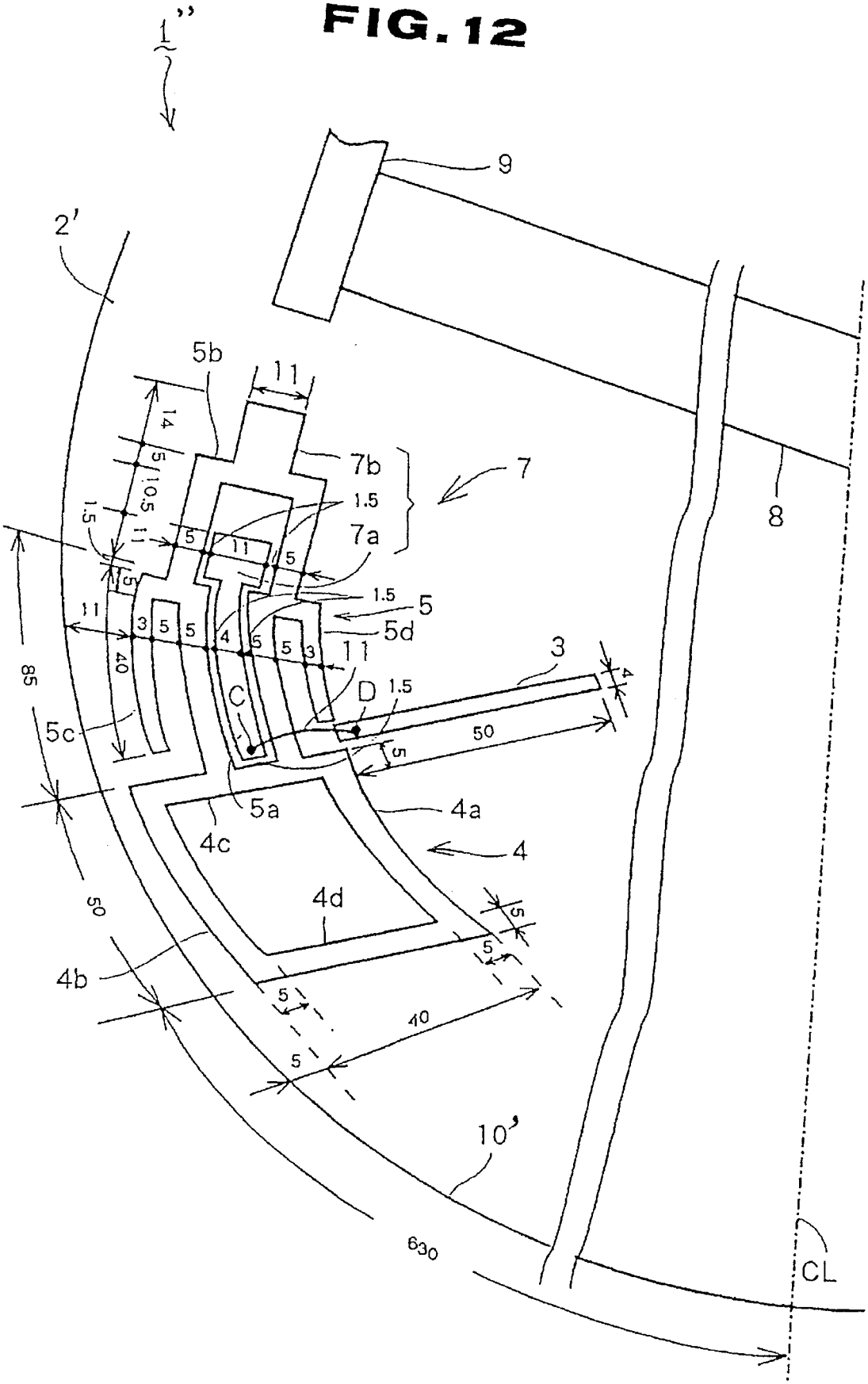
FIG. 12 is a plan view of an antenna pattern of a glass antenna device according to a third embodiment of the present invention, the view also showing preferred dimensions of the glass antenna device.

FIG. 12 shows a glass antenna device 1" according to a third embodiment of the present invention, which incorporates the principles of the glass antenna device 1' according to the second embodiment with a modified antenna pattern. Those parts shown in FIG. 12 which are functionally identical to those shown in FIG. 2 are denoted by identical reference characters.

The glass antenna device 1" according to the third embodiment is substantially the same as the glass antenna device 1' according to the second embodiment except that a jumper wire 11 interconnects different patterns.

According to the third embodiment, an outer frame pattern 4*c* of a ground pattern 4 and a shield leader pattern 5*b* are interconnected by an integral pattern, and a radiation pattern 3 and a signal leader pattern 4*a*, i.e., points C, D respectively thereon, are interconnected by a jumper wire 11.

Figure 13:
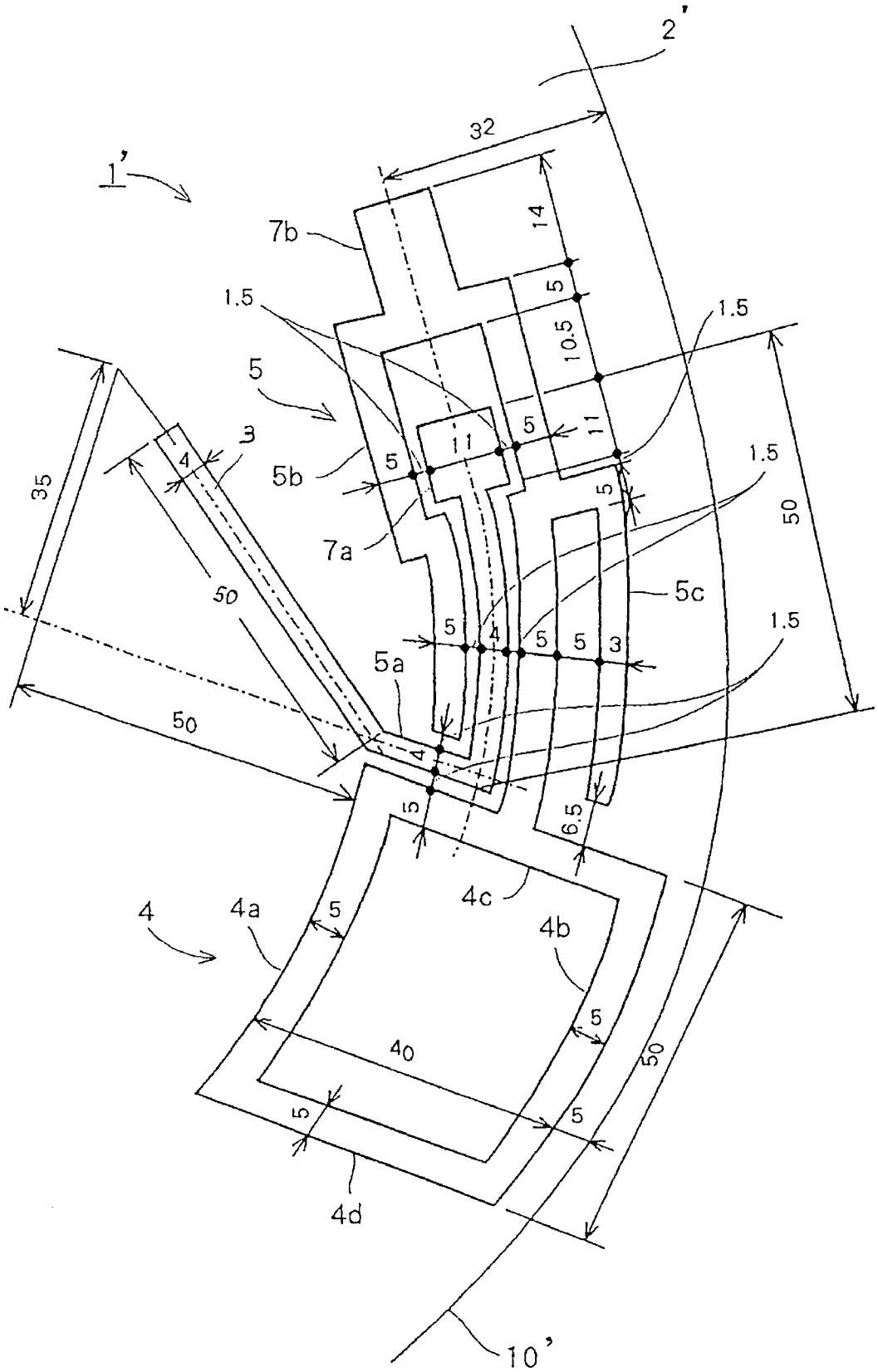
FIG. 13 is a plan view of a modification of the antenna pattern of the glass antenna device according to the second embodiment shown in FIG. 5.

In FIG. 12, the glass antenna device 1' is positioned closely to one side edge of a window glass panel 2'. However, as shown in FIG. 13, it may be positioned closely to an opposite side edge of a window glass panel 2' Furthermore, in each of the second and third embodiments, a radiation pattern 3 may be inclined with respect to a glass edge 10' as shown in FIG. 13 with preferred dimensions illustrated therein. The glass antenna device shown in FIG. 13 has an antenna pattern substantially similar to that which is shown in FIG. 5 except that an open distal end of a shield leader pattern 5*b* extending closely to a radiation pattern 3 is not connected to an outer frame pattern 4*c* of a ground pattern 4 by a jumper wire.

Figure 14:
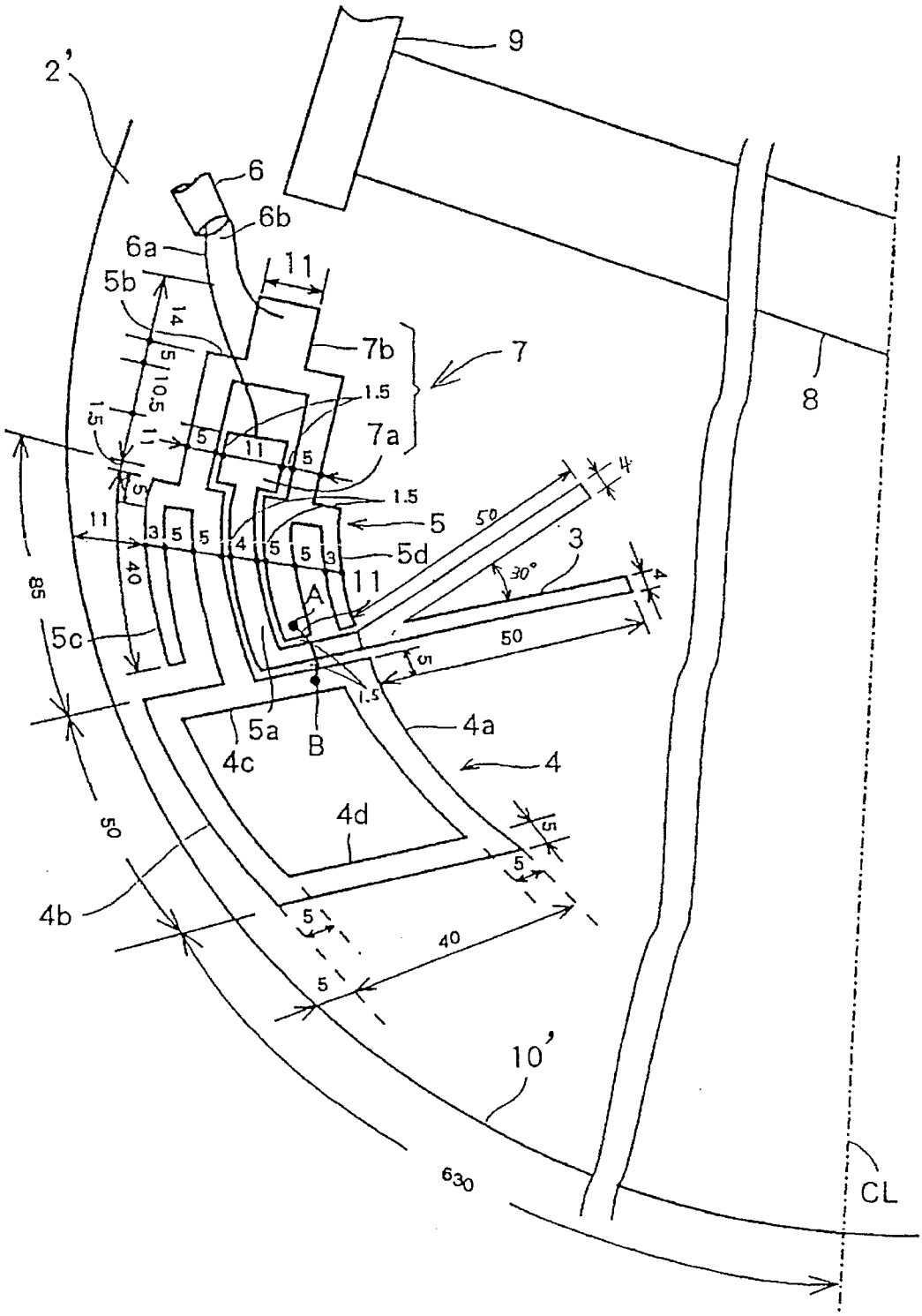
FIG.14 is a plan view of another modification of the antenna pattern of the glass antenna device according to the second embodiment shown in FIG. 5, the glass antenna device including a V-shaped radiation pattern.
Figure 15:
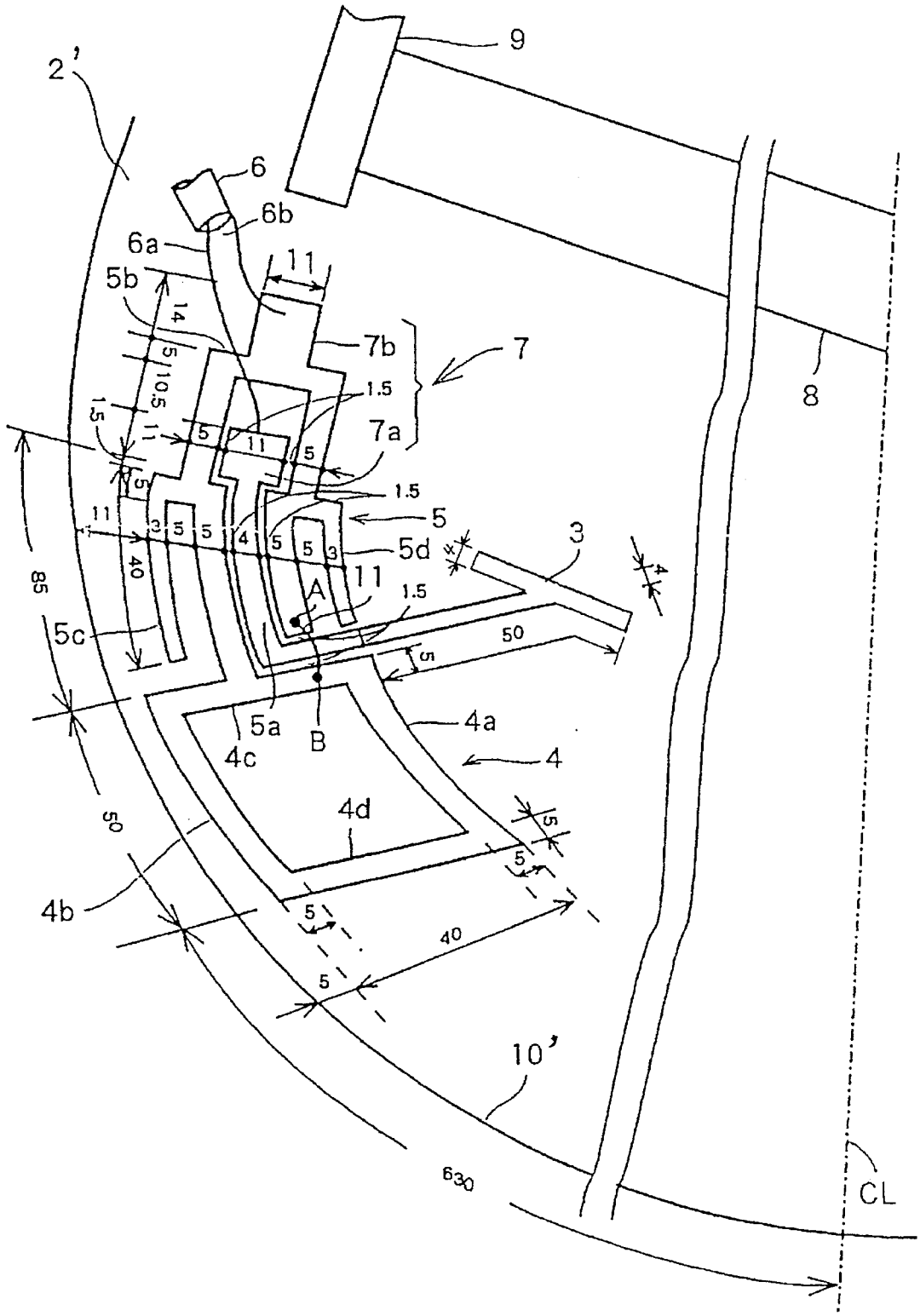
FIG. 15 is a plan view of still another modification of the antenna pattern of the glass antenna device according to the second embodiment shown in FIG. 5, the glass antenna device including a T-shaped radiation pattern.
Figure 16:
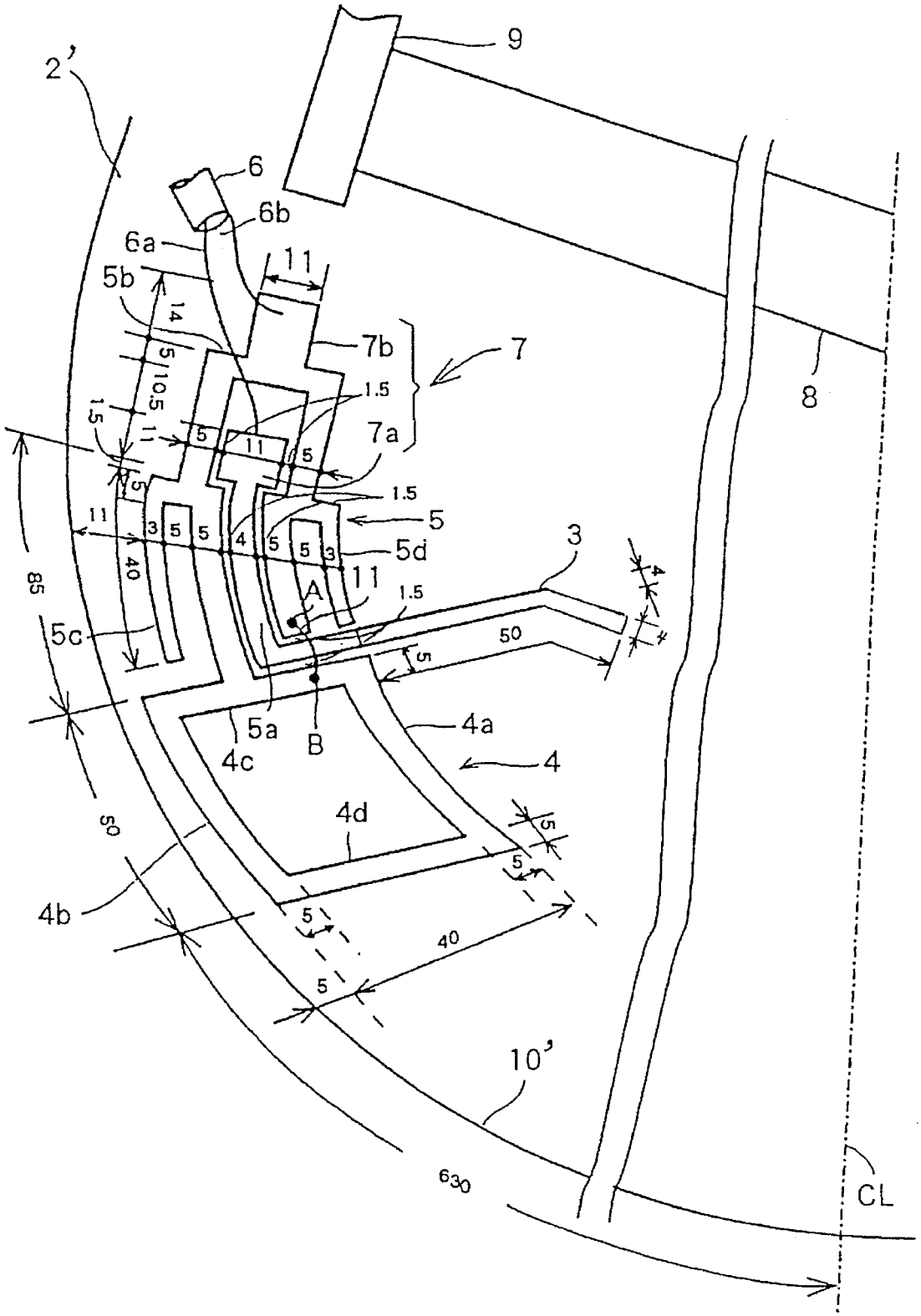
FIG. 16 is a plan view of a further modification of the antenna pattern of the glass antenna device according to the second embodiment shown in FIG. 5, the glass antenna device including a substantially inverted L-shaped radiation pattern.
Figure 17:
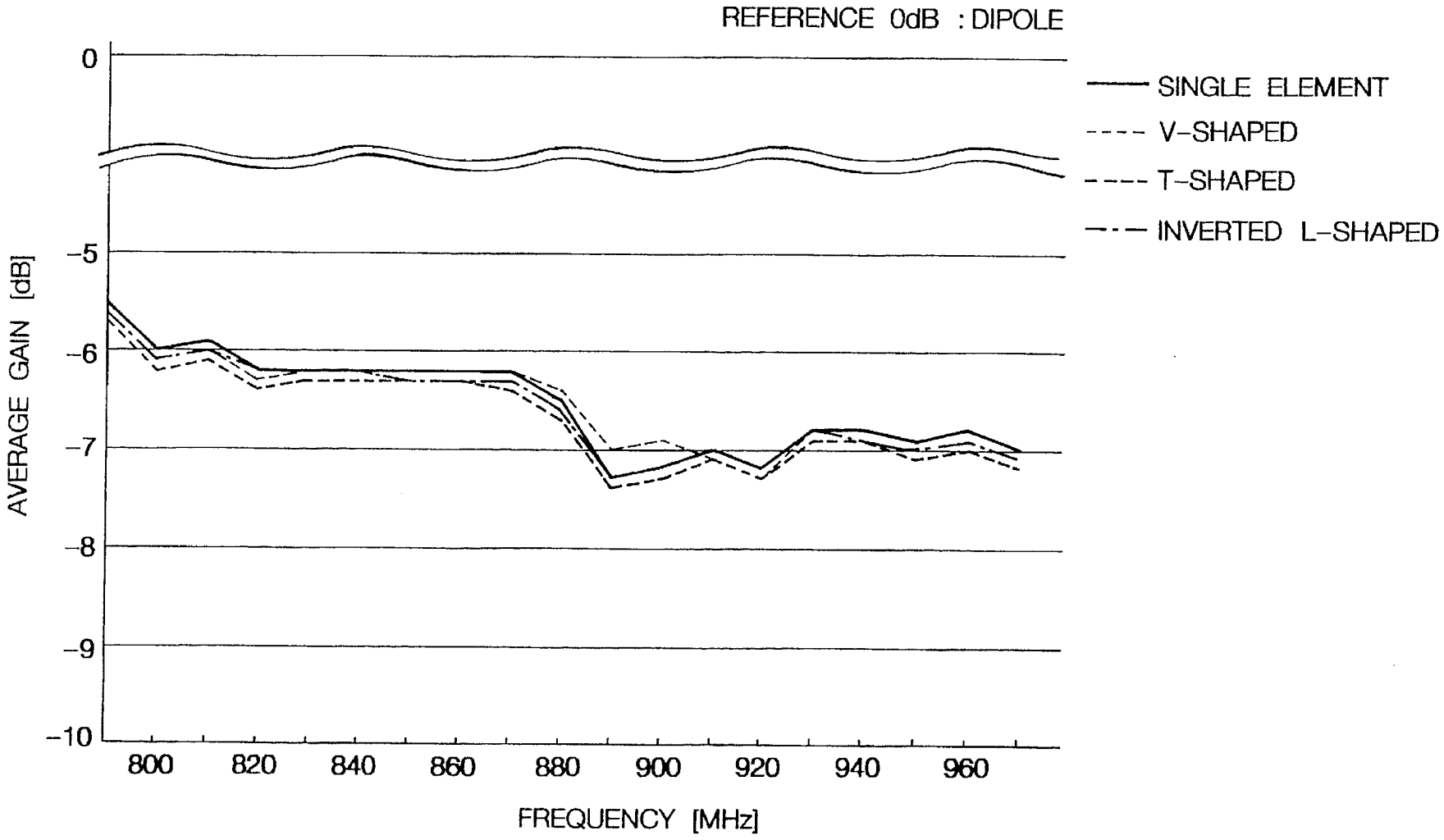
FIG. 17 is a graph showing the frequency-dependent antenna gains of the glass antenna devices shown in FIGS. 14 through 16.

In each of the first through third embodiments, the radiation pattern 3 is not limited to the illustrated I-shaped pattern, but may have an increased pattern width of 5 mm, may be composed of a plurality of narrow wires, or may have any of variously shaped patterns including V-shaped, T-shaped, and inverted L-shaped patterns. Such V-shaped, T-shaped, and inverted L-shaped radiation patterns 3 are illustrated respectively in FIGS. 14 through 16 in combination with the antenna pattern according to the second embodiment. The frequency-dependent antenna gains and their numerical values of these V-shaped, T-shaped, and inverted L-shaped radiation patterns shown in FIGS. 17 and 18.

With the glass antenna devices according to the above embodiments, as described above, the signal leader line extending from the feeder to the radiation pattern is surrounded by the shield leader line, and the rectangular ground pattern with a reduced horizontal dimension is connected to an end of the shield leader line. This arrangement allows the antenna pattern or at least the feeder of the antenna pattern to be positioned closely to a side edge of the window glass panel. Consequently, the window glass device can be fed from the side edge of the window glass panel, and aesthetically improved because the feeder can be concealed from view by an internal ornamental member or the like.

Since the open distal end of the shield leader line is connected to the ground pattern by the jumper wire, the impedance of the leader line is lowered to reduce any loss caused by the leader line. Therefore, a ground level with a low ground resistance can be provided, permitting the glass antenna device to exhibit sufficient performances even though it operates with side feeding.

Inasmuch as the ground pattern is of a centrally open rectangular shape, any temperature difference of the window glass panel which is developed at the time it is heated during the bending thereof is minimized. Therefore, the window glass panel suffers reduced strains when it is bent to a desired curvature.

A glass antenna device 100 for automobile telephone according to a fourth embodiment of the present invention will be described below with reference to FIGS. 19 and 20.

Figure 19:
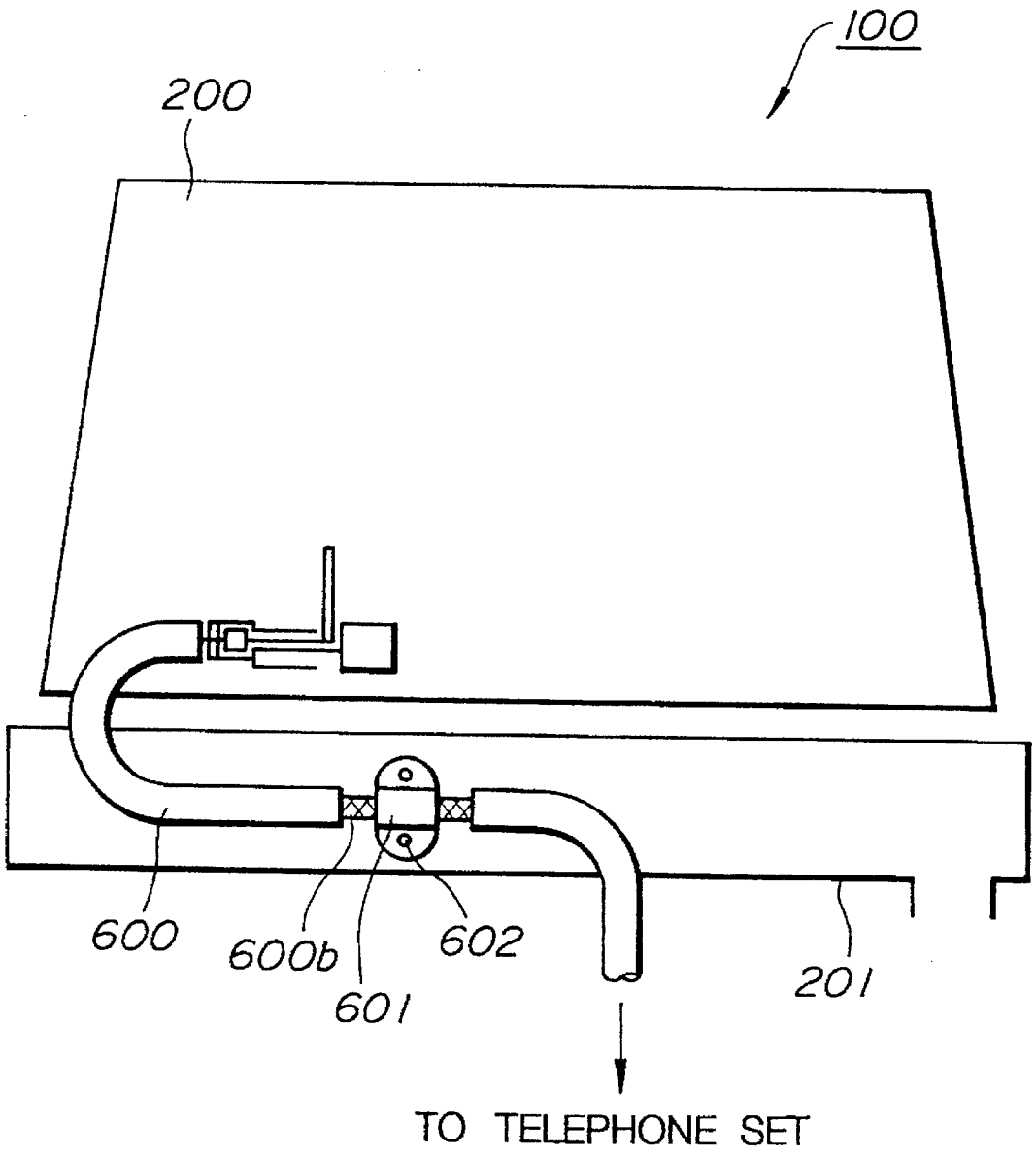
FIG. 19 is a schematic plan view of a glass antenna device for automobile telephone according to a fourth embodiment of the present invention.

As shown in FIG. 19, the glass antenna device 100 comprises an automobile window glass panel 200, an antenna pattern mounted on the automobile window glass panel 200 for an automobile telephone set (not shown), and a coaxial feeder cable 600 connecting the antenna pattern to the automobile telephone set. The coaxial feeder cable 600 has a portion stripped of the cable sheath, exposing a ground conductor (outer conductor) 600*b*, and the exposed ground conductor 600*b* is pressed against an electrically conductive member such as window frame 201 by a ground fastener 601 that is secured by screws 602. In this manner, the glass antenna device 100 is grounded to the automobile body.

The coaxial feeder cable 600 comprises a coaxial feeder cable under the type No. 2.5D-2V, and has a length of about 200 mm from the feeder where the coaxial feeder cable 600 is connected to the antenna pattern, to the position where the exposed ground conductor 600*b* is connected to the window frame 201.

The antenna pattern of the glass antenna device 100 is spaced about 500 mm to the left from the horizontal central line of the window glass panel 200, and positioned closely to a lower edge of the window glass panel 200.

Figure 20:
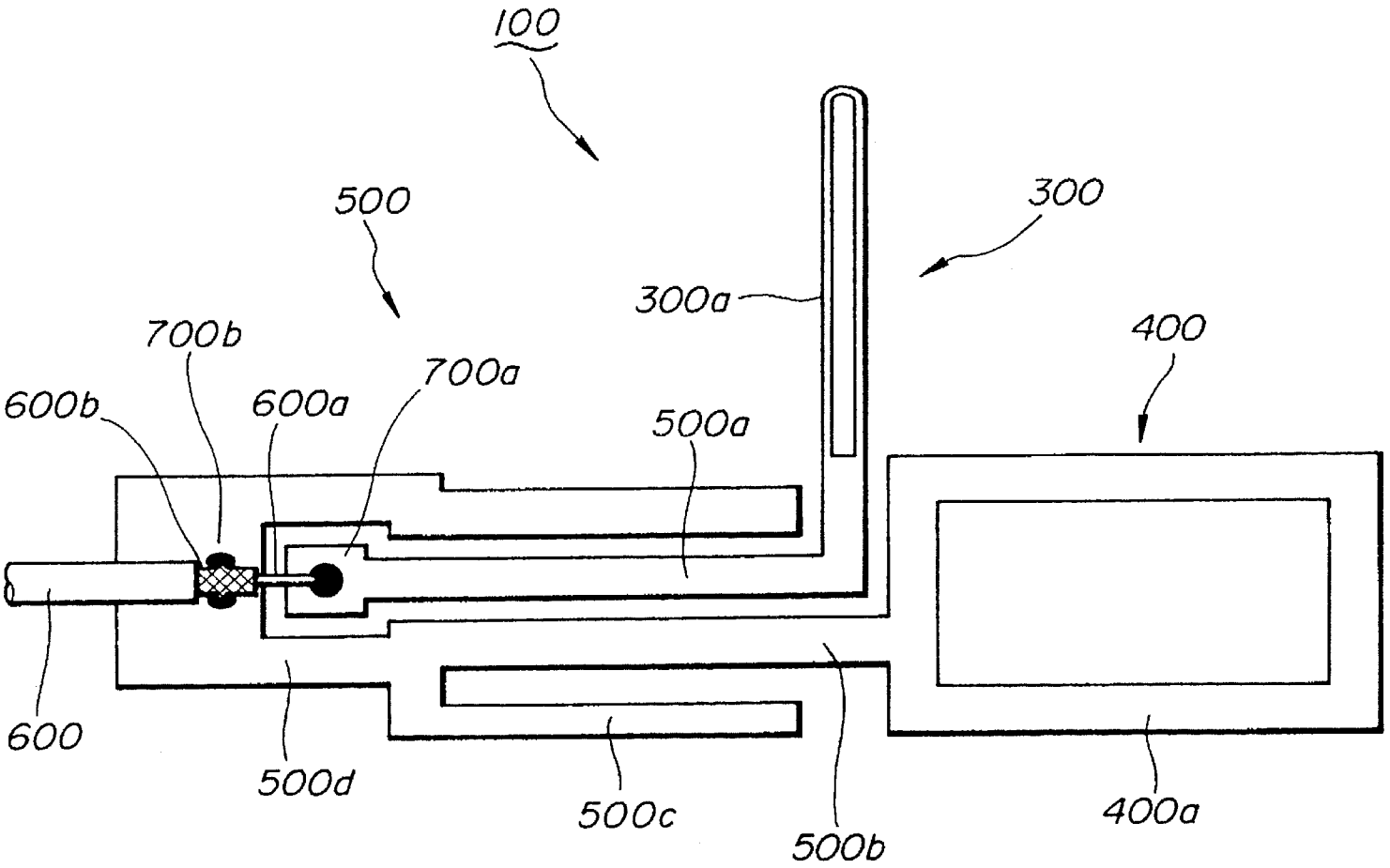
FIG. 20 is an enlarged plan view showing in detail an antenna pattern of the glass antenna device according to the fourth embodiment shown in FIG. 19.

As shown in FIG. 20, the antenna pattern of the glass antenna device 100 comprises a radiation pattern 300, a ground pattern 400, and a leader line 500.

The radiation pattern 300 includes a vertical linear radiation pattern 300*a*. The leader line 500 includes a signal leader pattern 500*a* connected no the lower end of the vertical linear radiation pattern 300*a* and extending to the left into a first feeder 700*a*.

The ground pattern 400 includes a centrally open rectangular ground pattern 400*a* positioned on the right-hand side of the radiation pattern 300. The leader line 500 also includes a shield leader pattern including an extension 500*b* extending linearly to the left from the ground pattern 400*a* parallel to the signal leader pattern 500*a* on one side thereof, a surrounding pattern 500*d* extending from the shield leader pattern 500*b* in surrounding relation to the first feeder 700*a*, an extension extending to the right from the surrounding pattern 500*d* parallel to the signal leader pattern 500*a* on the other side thereof, and a branch pattern or Sperrtopf element 500*c* branched off the extension 500*b* to the right. The surrounding pattern 500*d* has a wide left-hand portion serving as a second feeder 700*b*.

The coaxial feeder cable 600 has a core 600*a* connected at its end to the first feeder 700*a*. The ground conductor 600*b* of the coaxial feeder cable 600 has its end connected to the second feeder 700*b*.

The radiation pattern 300*a* and the ground pattern 400*a* are of a centrally open shape. However, they may be of a solid shape.

The impedance of the coaxial feeder cable 600 and the impedance of the antenna pattern of the glass antenna device 600 are sufficiently matched such that the antenna characteristics will not greatly be altered by the grounding of the coaxial feeder cable 600 to the automobile body.

Figure 21:
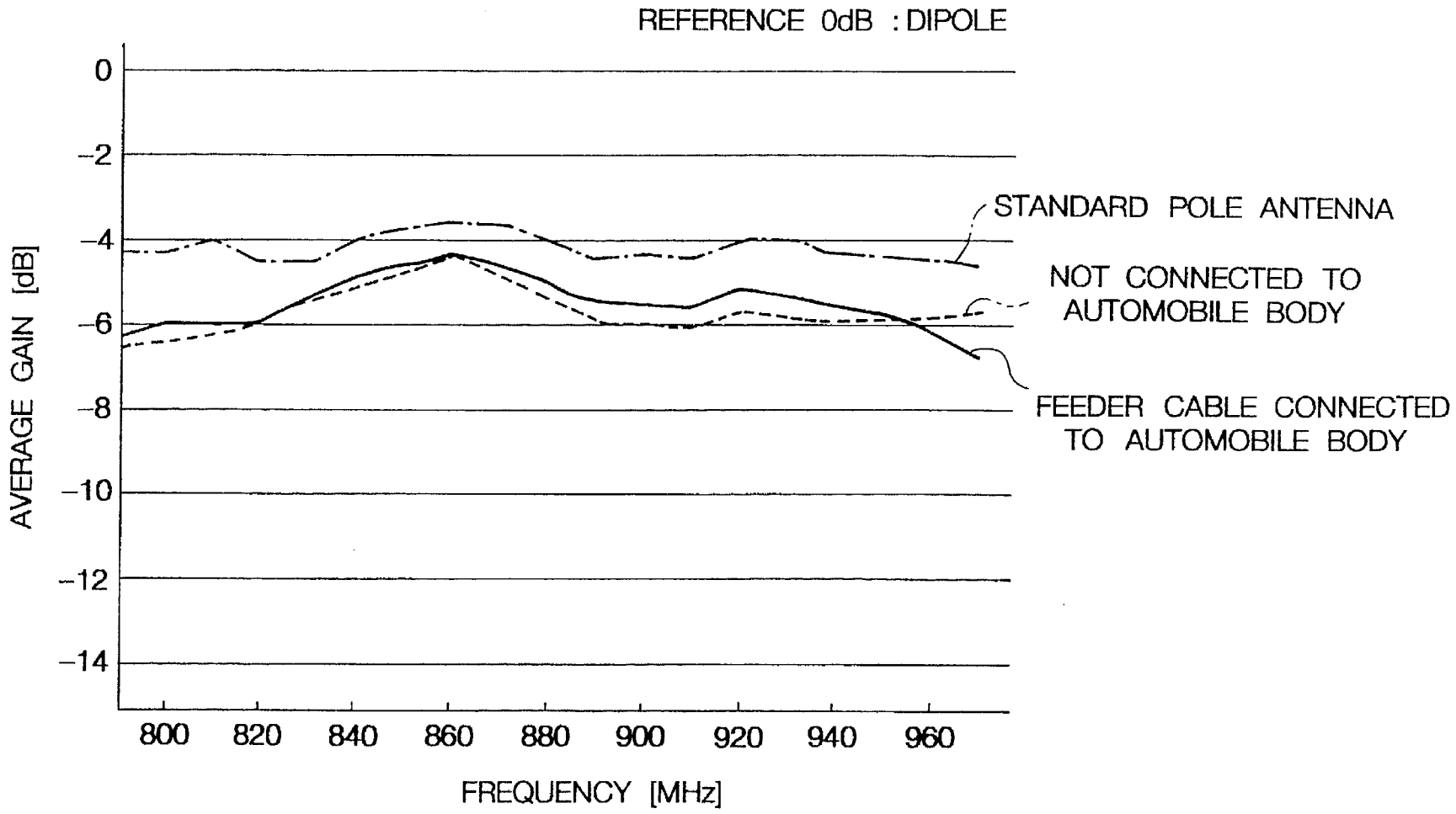
FIG. 21 is a graph showing the frequency-dependent antenna gains of the glass antenna device according to the fourth embodiment.

FIG. 21 shows the frequency-dependent antenna gains of the glass antenna device 100 according to the fourth embodiment shown in FIG. 20.

The solid-line curve in FIG. 21 represents the frequency-dependent antenna gains of the glass antenna device 100 with the coaxial feeder cable 600 being grounded, and the dotted-line curve in FIG. 21 represents the frequency-dependent antenna gains of the glass antenna device 100 with the coaxial feeder cable 600 being nod grounded. The dot-and-dash-line curve in FIG. 21 represents the frequency-dependent antenna gains of a standard pole antenna. Review of FIG. 21 indicates that the frequency-dependent average sensitivity of the glass antenna device remains almost unchanged even if the coaxial feeder cable 600 is grounded.

The difference between the average sensitivity of the glass antenna device 100 shown in FIG. 20 and that of the standard pole antenna falls within 2 dB. Therefore, the glass antenna device 100 has good sensitivity vs. frequency characteristics as a window glass antenna.

Figure 22:
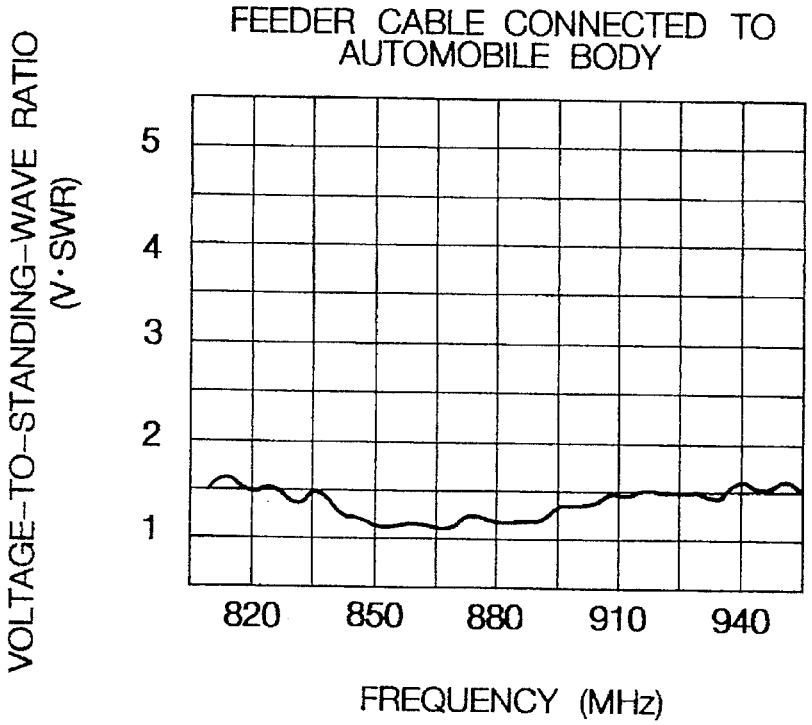
FIG. 22 is a graph of the frequency-dependent characteristics of the voltage-to-standing-wave ratio of the glass antenna device according to the fourth embodiment with a feeder cable connected to an automobile body.
Figure 23:
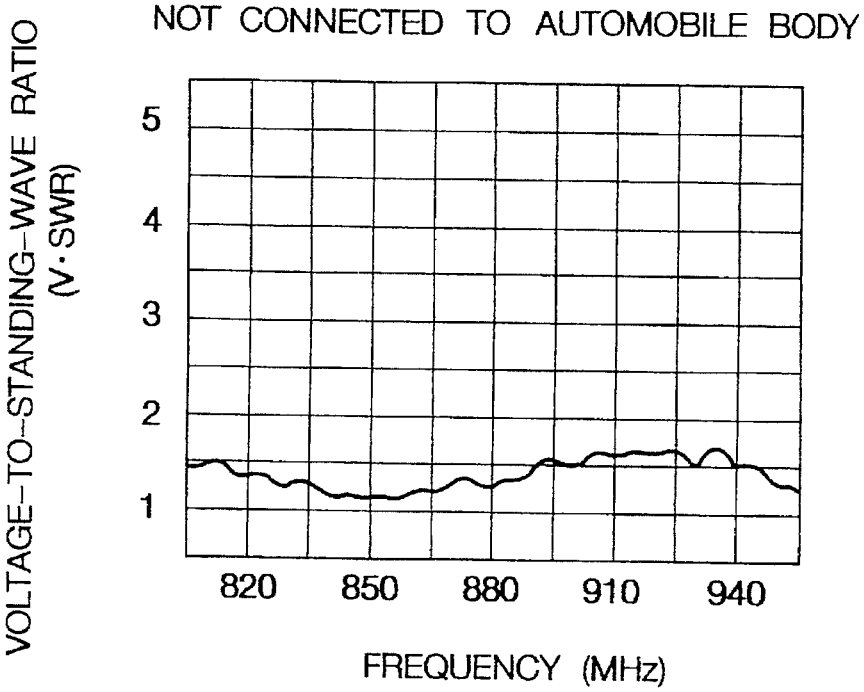
FIG. 23 is a graph of the frequency-dependent characteristics of the voltage-to-standing-wave ratio of the glass antenna device according to the fourth embodiment with the feeder cable not connected to the automobile body.

FIGS. 22 and 23 illustrate the frequency-dependent characteristics of the voltage-to-standing-wave ratio of the glass antenna device 100 according to the fourth embodiment. The characteristic curve shown in FIG. 22 is obtained when the coaxial feeder cable 600 is grounded, and the characteristic curve shown in FIG. 23 is obtained when the coaxial feeder cable 600 is not grounded. The voltage-to-standing-wave ratio remains substantially the same even if the coaxial feeder cable 600 is grounded. This indicates that the glass antenna device 100 has achieved stable impedance matching irrespective of whether the coaxial feeder cable 600 is grounded or not.

Since a portion of the coaxial feeder cable 600 is stripped off the cable cover and the exposed ground conductor 600*b* thereof is grounded to the automobile body by the ground fastener 601, the impedance of the ground pattern 400 with respect to the automobile body is lowered, thus lessening the entry of noises from other electronic devices.

Figure 25:
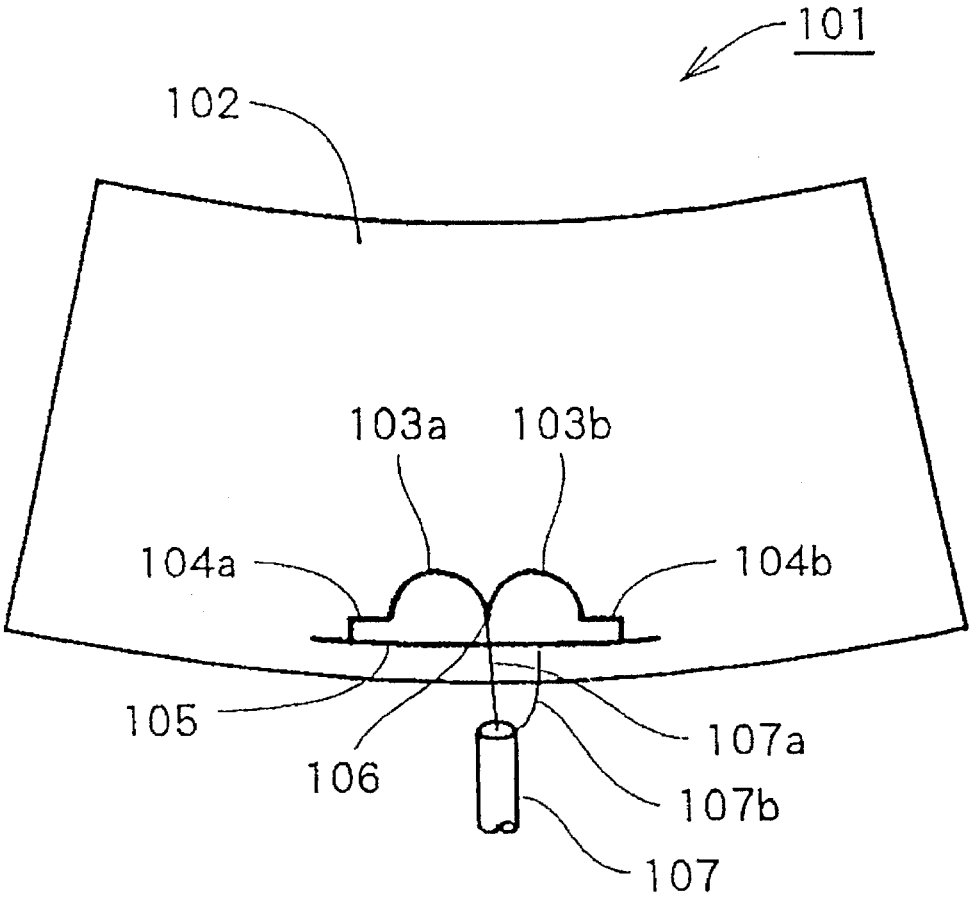
FIG.25 (PRIOR ART)
FIG. 25 is a schematic plan view of another conventional glass antenna device for automobile telephone.

The antenna pattern of the glass antenna device 100 according to the fourth embodiment is not limited to a modified monopole pattern as shown in FIG. 20, but may be any of various patterns, e.g., the double-loop antenna pattern shown in FIG. 25, provided they can accomplish sufficient impedance matching.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A glass antenna device for automobile telephone, comprising:

a glass panel with an edge; and an antenna pattern mounted on said glass panel; said antenna pattern comprising:

a radiation pattern extending away from the edge of said glass panel;

a signal leader pattern positioned closely to the edge of said glass panel and extending to one side of said radiation pattern relative to the longitudinal direction of said radiation pattern, said signal leader pattern having a feeder electrode and an extension extending from said feeder electrode toward and connected to said radiation pattern;

a shield leader pattern having a surrounding portion in surrounding relation to said feeder electrode on three sides thereof, said shield leader pattern including a ground electrode, said shield leader pattern also having a pair of parallel extensions extending from said surrounding portion substantially the full length of said extension of the signal leader pattern and being parallel to and disposed one on each side of said signal leader pattern; and a ground pattern being of a centrally open rectangular loop shape connected to an end of at least one of said parallel extensions of said shield leader pattern.

2. A glass antenna device according to claim 1, wherein said shield leader pattern has a balanced-to-unbalanced converter.

3. A glass antenna device according to claim 1 including balanced-to-unbalanced converter, said balanced-to-unbalanced converter comprising a branch pattern branched from an intermediate portion of at least one of said parallel extensions of said shield leader pattern and extending substantially parallel to said extension of said signal leader pattern.

4. A glass antenna device according to claim 1, wherein said parallel extensions have respective ends and said signal leader pattern is connected to said radiation pattern at a junction and wherein said device further includes means for connecting said respective ends of said parallel extensions, said connecting means being held out of contact with said junction.

5. A glass antenna device according to claim 4, wherein said device further includes a jumper wire bridging three-dimensionally over said junction and connecting one end of one of said parallel extensions to said ground pattern.

6. A glass antenna device according to claim 1, wherein said parallel extensions have respective ends, said respective ends being connected to said ground pattern, said device further including a jumper wire bridging three-dimensionally over at least one of the parallel extensions and connecting said extension of the signal leader pattern to said radiation pattern.

7. A glass antenna device according to claim 1, wherein said radiation pattern is substantially I-shaped.

8. A glass antenna device according to claim 1, wherein said radiation pattern is substantially T-shaped.

9. A glass antenna device according to claim 1, wherein said radiation pattern is substantially V-shaped.

10. A glass antenna device according to claim 1, wherein said radiation pattern is substantially inverted L-shaped.

11. A glass antenna device according to claim 1, wherein said edge of the glass panel is straight, said extension of the signal leader pattern extending linearly parallel to said straight edge of the glass panel.

12. A glass antenna device according to claim 1, wherein said edge of the glass panel is curved, said feeder electrode being positioned closely to the curved edge of the glass panel, said extension of the signal leader pattern being curved similar to the curved edge of the glass panel.

13. A glass antenna device according to claim 1, further comprising a feeder cable interconnecting said antenna pattern and an automobile telephone set mounted in an automobile, said feeder cable having a portion extending toward said antenna pattern and including a ground conductor electrically connected to an automobile body of the automobile.

* * * * *